United States Patent [19]

Everall, Jr. et al.

[11] 4,388,879

[45] Jun. 21, 1983

[54] APPARATUS FOR SEQUENTIALLY FABRICATING PILLOWCASES OR LIKE PRODUCTS

[75] Inventors: Palmer B. Everall, Jr.; Jack R. Lowery, Sr., both of Lancaster, S.C.

[73] Assignee: Springs Mills, Inc., Fort Mill, S.C.

[21] Appl. No.: 263,686

[22] Filed: May 14, 1981

[51] Int. Cl.[3] ..... D05B 13/00

[52] U.S. Cl. ..... 112/10; 112/121.29; 112/304; 112/307

[58] Field of Search ..... 112/10, 11, 121.29, 112/121.12, 121.15, 303, 304, 307, 121.26, 121.27

[56] References Cited

U.S. PATENT DOCUMENTS

| | | | |
|---|---|---|---|
| 2,940,404 | 6/1960 | Damon | 112/10 |
| 3,126,848 | 3/1964 | Gastonguay | 112/10 |
| 3,223,059 | 12/1965 | Jacobs | 112/121.12 |
| 3,224,394 | 12/1965 | Dobner et al. | 112/10 |
| 3,227,118 | 1/1966 | Gore | 112/10 |
| 3,310,207 | 3/1967 | Gore | 112/10 X |
| 3,773,002 | 11/1973 | Burton | 112/121.12 |
| 4,214,541 | 7/1980 | Zeigler, Jr. et al. | 112/121.10 X |
| 4,224,883 | 9/1980 | Zeigler, Jr. et al. | 112/121.10 |

*Primary Examiner*—H. Hampton Hunter

*Attorney, Agent, or Firm*—Bell, Seltzer, Park & Gibson

[57] ABSTRACT

Apparatus for sequentially fabricating pillowcases or like products wherein mechanisms are provided for automatically feeding continuous tubular material from a supply means to a cutter mechanism and for cutting the material into individual pieces of predetermined desired lengths for either "regular cut" pillowcases in which each pillowcase is cut a predetermined desired length or "panel cut" pillowcases in which each pillowcase is cut a predetermined desired length from a printed panel design. The apparatus includes mechanisms for clamping one of the cut ends of each cut piece while allowing the remaining portion of the cut pieces to hang down in a generally vertically-extending position and for conveying the cut pieces sequentially past a stitching mechanism to complete fabrication of the pillowcases.

11 Claims, 15 Drawing Figures

AIR
AIR
AIR

M
120
TACH
121
M
CONVEYOR 68
CUTTING END
CONVEYOR 75
SEWING END
199
185
REVERSING
RELAYS
166
54
M
CUTTER ACROSS
DRIVE MOTOR
177
PROX.
33
CR
SCRAY
24
MOTOR
CUTTER
POWER SUPPLY
168
M
CUTTER MOTOR 30V
106
107
SV
NIP ROLL
OPEN-CLOSE
AIR
V
46
43
47
COLOR
SCANNER
POWER SUPPLY
149
115
117
116
110
112
CR
"STOP"
START
113
CR
112
142
TM
"AUTOMATIC
RUN"
140
141
143
CLUTCH
REG. CUT
CR
142
147
135
143
SV
144
AIR
V
CR
151
149
150
144
CR
135
153
142
CLUTCH
PANEL
CR
BRAKE
CUT
150
151
150
161
147
TOP
CR
CLAMP
155
BRAKE
155
147
145
CR
REG.
CUT
156

APPARATUS FOR SEQUENTIALLY FABRICATING PILLOWCASES OR LIKE PRODUCTS

FIELD OF THE INVENTION

This invention relates to apparatus for sequentially fabricating pillowcases or like products wherein continuous tubular material is automatically handled and cut into individual pieces of predetermined desired lengths for either "regular cut" pillowcases in which each pillowcase is cut a predetermined desired length, or "panel cut" pillowcases in which each pillowcase is cut a predetermined desired length from a printed panel design. The apparatus includes mechanisms for conveying the cut pieces past a stitching mechanism with the end to be stitched clamped and the remaining portion of the cut pieces hanging down in a generally vertically-extending position.

BACKGROUND OF THE INVENTION

Although various apparatus have been proposed and commercialized over the years for use in fabricating pillowcases or like products, such apparatus have suffered from one or more drawbacks including lack of a desired amount of automation, size of the apparatus requiring excessive floor space in a manufacturing plant, inability to automatically fabricate either "regular cut" or "panel cut" pillowcases on the same apparatus, etc.

Accordingly, it is the object of this invention to provide an apparatus for sequentially fabricating pillowcases or like products which performs its fabrication operations automatically and which can be regulated for fabricating either "regular cut" or "panel cut" pillowcases.

It is a further object of this invention to provide an apparatus for sequentially fabricating pillowcases or like products which provides improved handling of the material to reduce the size of the apparatus so as to reduce floor space required for the apparatus in the manufacturing plant.

SUMMARY OF THE INVENTION

By this invention, it has been found that the above objects can be accomplished by providing apparatus for sequentially fabricating pillowcases or like products automatically from a continuous flat tubular material wherein mechanisms feed the material from a supply mechanism to a cutter mechanism for transversely cutting the material into individual pieces.

The apparatus also includes improved means operatively connected with and automatically controlling the operation of the cutting mechanism and the feeding mechanisms for sequentially cutting the material into individual pieces of predetermined dimensions for the pillowcases. This control means includes mechanisms for regulating the control means to control the cutting mechanism and the feeding mechanism for fabricating either "regular cut" pillowcases in which the pillowcase is cut a predetermined desired length, or "panel cut" pillowcases in which each pillowcase is cut a predetermined desired length, from spaced separate printed panel designs on the material.

The apparatus further includes improved conveying means for sequentially receiving the individual cut pieces of material, clamping one of the transverse cut ends thereof while allowing the remainder of the cut pieces of material to hang downwardly in a generally vertically-extending position, and conveying and so-positioned cut pieces sequentially in a generally straight-lined path of travel past a stitching mechanism for stitching the clamped transverse cut end of each piece of material while being conveyed by the conveyor mechanisms to complete fabrication of the pillowcases.

The apparatus may further include mechanisms for doffing the fabricated pillowcases from the conveyor mechanisms and for stacking the pillowcases into individual stacks of a predetermined number of pillowcases and for accumulating a predetermined number of stacks for removal by an operator.

BRIEF DESCRIPTIONS OF THE DRAWINGS

Some of the objects and advantages of this invention having been set forth, other objects and advantages will appear when taken in conjunction with the accompanying drawings, in which.

Figure 11:
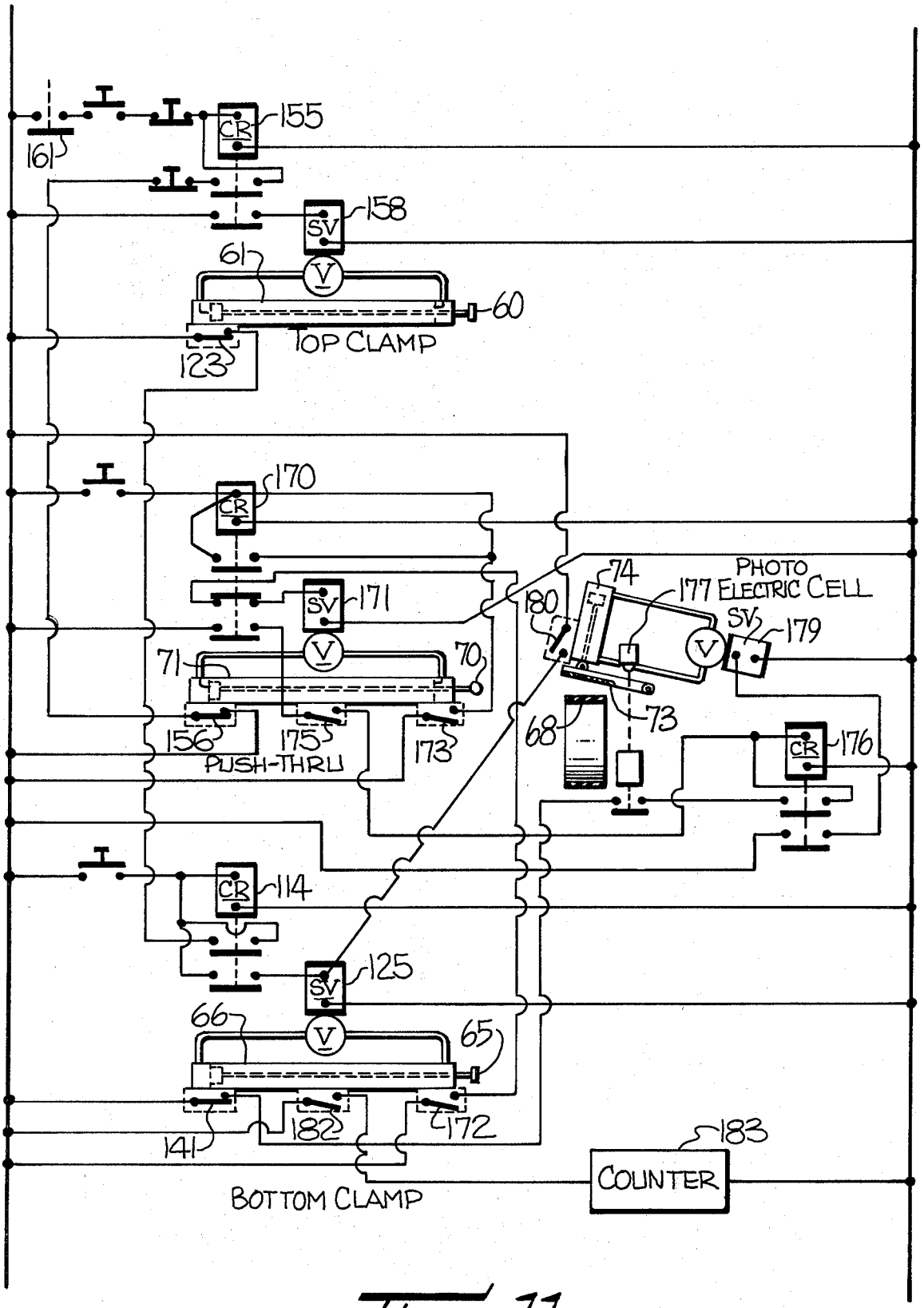

FIG. 11 is a schematic electrical/mechanical view illustrating operation of the mechanisms utilized for clamping the material during the cutting operation and placing the cut pieces of material in the conveyor mechanism for conveying away the pieces from the cutting mechanism after cutting; and FIGS. 12 A–D are continuation views of an electrical schematic of the apparatus of this invention, particularly the control mechanisms therein.

DETAILED DESCRIPTION OF INVENTION

Figures 1, 2:
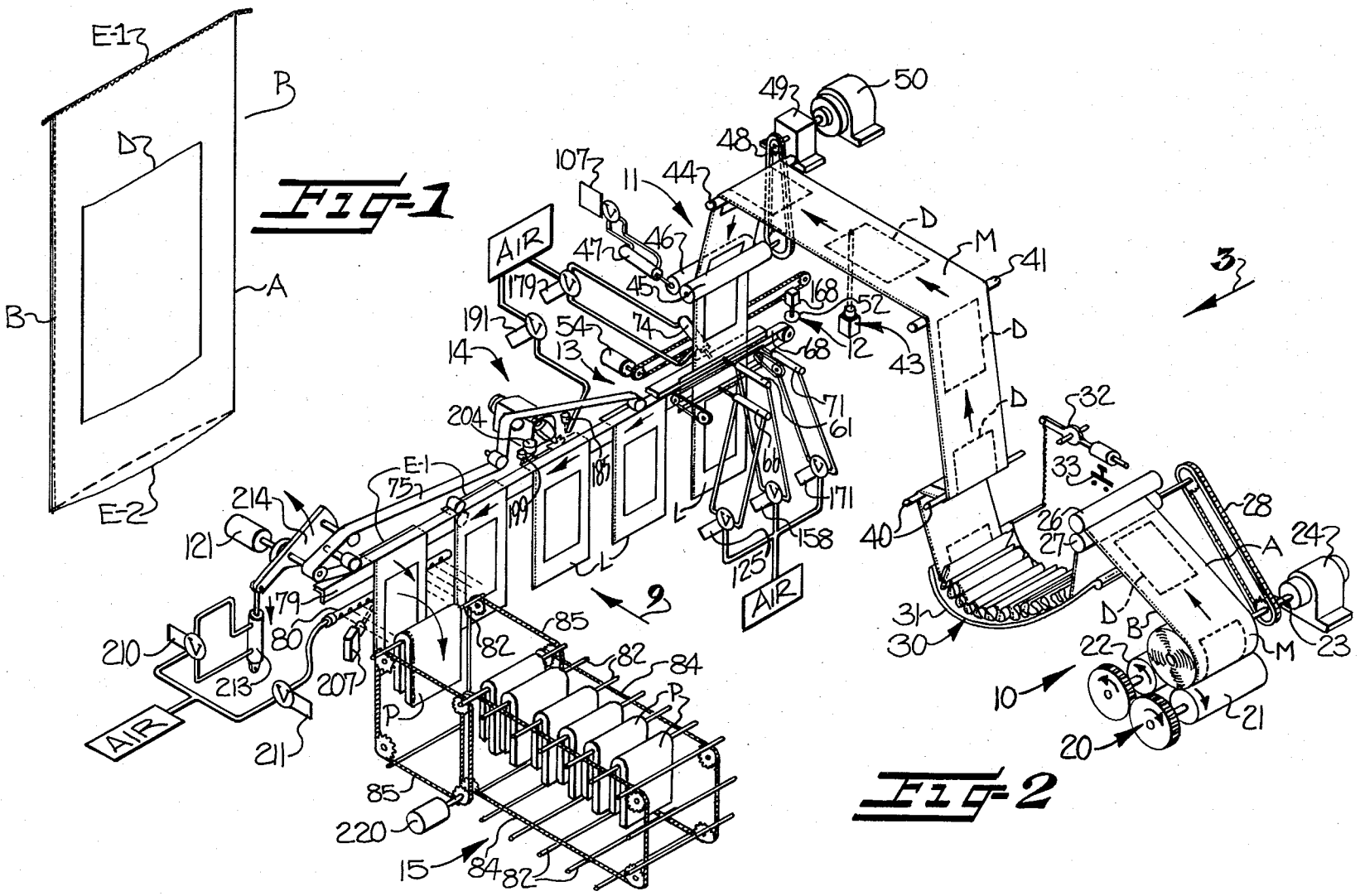
FIG. 1 is a perspective view of a pillowcase fabricated with the apparatus of this invention.
FIG. 2 is a perspective schematic view, with frame and other portions omitted for clarity, of an apparatus in accordance with this invention.

In the drawings, one embodiment of an apparatus for sequentially fabricating pillowcases P (as shown in FIG. 1) or like products, such as bags and other similarily constructed products, is schematically illustrated. However, it is to be understood that other apparatus utilizing the novel features of this invention could be provided.

Broadly (as schematically illustrated in FIG. 2), the apparatus of this invention includes means, generally indicated at 10, for supplying continuous flat tubular material M. This flat tubular material M may be a continuous sheet of textile fabric normally utilized for pillowcases P which has been previously folded longitudinally about its central longitudinal axis A and then side seamed at B along the other longitudinal edge to form flat, two layer, tubular material M.

This flat, folded, side seamed, two layer, tubular material M is then fed by feeding means, generally indicated at 11, from the supply means 10 to cutting means, generally indicated at 12, for transversely cutting the continuous material M into individual pieces L.

Electrical and mechanical control means, to be described in detail below and schematically illustrated in the drawings, are operatively connected with and control the operation of the cutting means 12 and the feeding means 11 for sequentially cutting the continuous material M into individual pieces L of desired predetermined dimensions for the pillowcases P. Such control means, as will be described hereinafter, include provisions for regulating the control means to control the feeding means 11 and cutting means 12 for fabricating (1) "regular cut" pillowcases P in which each of the pillowcases are of a predetermined desired length and (2) "panel cut" pillowcases P in which the continuous material M has spaced-apart printed panel designs D and in which it is desired to cut each pillowcase a predetermined distance or centrally between the printed panels D.

Conveying means, generally indicated at 13, are provided for sequentially receiving the individually cut pieces L, clamping one of the transverse cut ends E1 thereof, while allowing the remainder of the cut pieces L to hang downwardly in a generally vertically-extending position, and conveying the so-positioned cut pieces L sequentially in a generally straight-line path of travel. Means, generally indicated at 14, are provided for stitching the clamped transverse cut end E1 of each piece L while being conveyed by the conveyor means 13 to complete fabrication of the pillowcases P (as shown in FIG. 1), which are closed on three sides and have an open end E2.

From the conveyor means 13, the pillowcases P may be doffed onto a stacking and an accumulating means, generally indicated at 15, for forming individual stacks of a predetermined number of pillowcases P, as will be described below.

For a better understanding of the above described broad features of the apparatus of this invention, a *mechanical sequence of operation* will now be described.

To start-up operation of the apparatus, an operator first places a roll of continuous material M onto a driven let-off mechanism 20, forming a part of the supply means 10 and consisting of a pair of friction drive rolls 21, 22 which receive the roll of material M on the top surface. thereof. These rolls 21, 22 are geared together and driven through shaft 23 from motor 24. The end of the material M is then threaded through driven nip-rolls 26, 27 which are driven by a chain and sprocket mechanism 28 from the shaft 23 of motor 24. The nip-rolls 26, 27 feed the material M into an automatic scray mechanism 30 which consists of a sheet-metal pan 31 that is balanced through a weighted pivot mechanism 32 so that when it fills up with the desired amount of material M it causes the nip-rolls 26, 27 and driven let-off 20 to stop. As the material M is pulled out of the pan 31, the pan 31 raises to a point that a proximity switch 33 is closed and causes the nip-rolls 26, 27 and driven let-off 20 to start-up again through the motor 24, in a manner to be discussed in more detail below. This procedure repeats as long as the apparatus is running. These devices are all mounted on a frame section F1 (see FIG. 3) and form the supply means 10.

Figure 3:
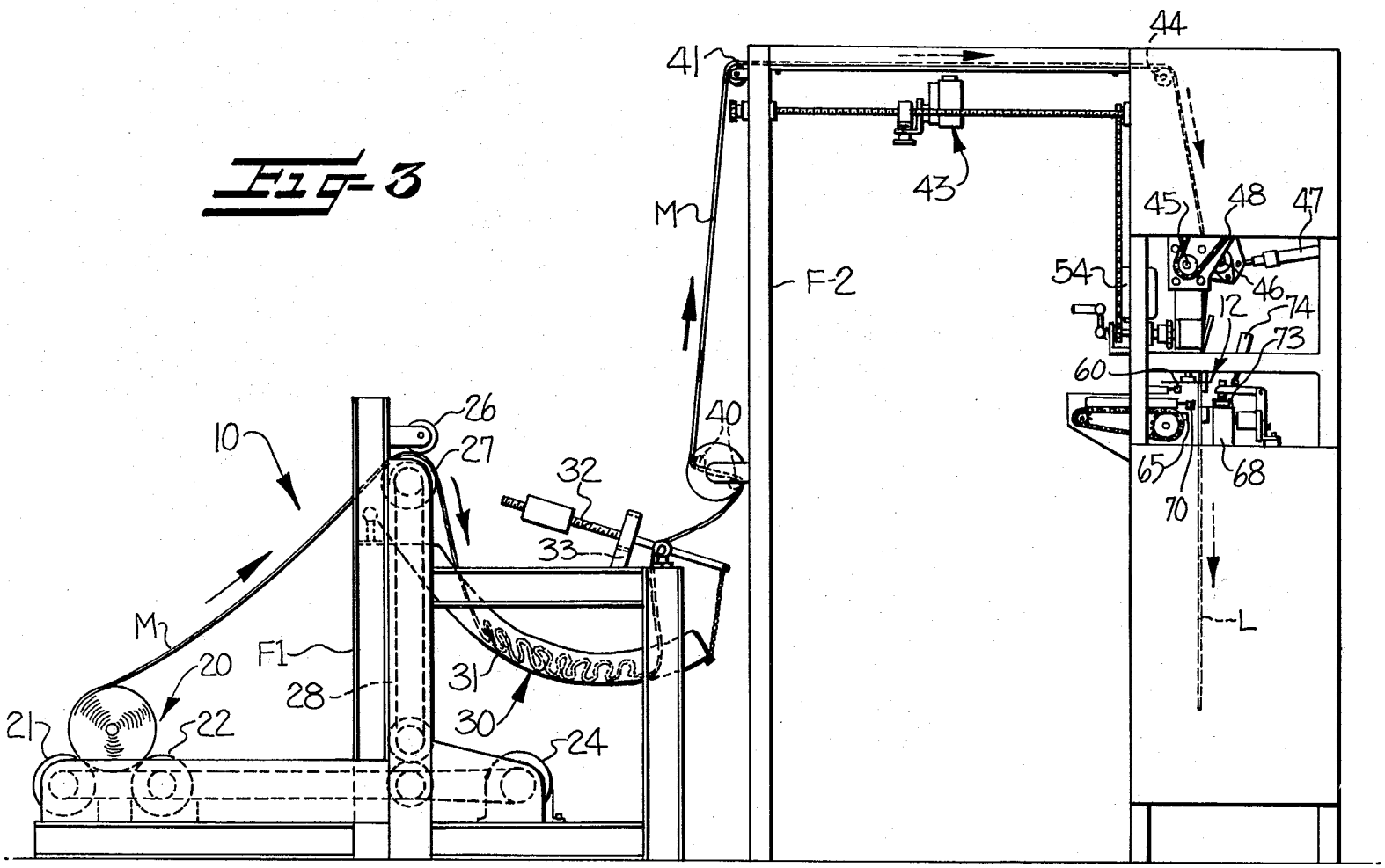
FIG. 3 is a partial side elevational view, taken generally in the direction of the arrow 3 in FIG. 2.
Figure 4:
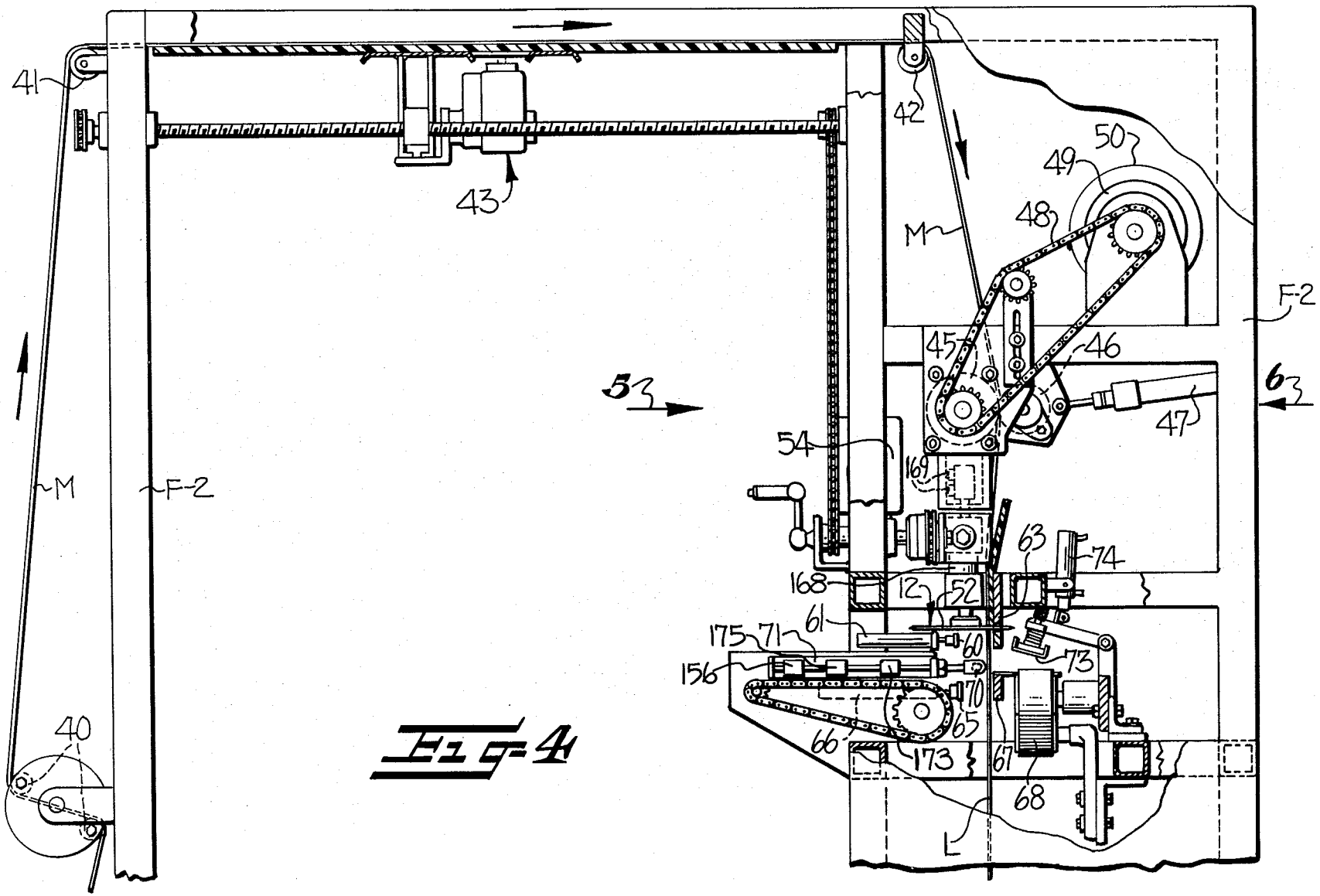
FIG. 4 is an enlarged side elevational view of a portion of the apparatus shown in FIG. 3, with parts of the covering frame portion removed.

The end of the continuous material M is then threaded through a drag bar tensioning mechanism 40 over another drag bar 41 through an optical color or shade photoelectric cell scanning device 43 to be described more fully below, over another drag bar 44 and down to feeding nip-rolls 45, 46. Nip-rolls 45, 46, as well as drag rolls 41, 44, scanning device 43 and drag bar device 41 are mounted on a frame section F2, (see FIG. 3), which is generally in alignment with the frame section F1 carrying the material supply means 10 so that the material M travels in a first, generally straight-line, path of travel from the supply means 10 to the feeding nip-rolls 45, 46. The material is carried in a generally inverted U-shaped path of travel from the drag bar mechanism 40 to the feeding nip-rolls 45, 46. The scanning device 43 is positioned in generally the apex of the inverted U-shaped path of travel so that an operator may easily obtain access thereto by walking under the inverted U-shaped path of travel of the material M. The feeding nip-rolls 45, 46 are rotatably mounted on the frame F2, (as shown in FIGS. 3 and 4). The roll 46 is pivotally mounted for movement by a pneumatic piston and cylinder mechanism 47 (see FIG. 4) for movement into and out of feeding engagement with the roll 45 for threading of the material M therebetween. The roll 45 is suitably driven by a chain and sprocket drive 48 from a clutch/brake device 49 and motor 50.

After the material M is threaded though the feeding nip-rolls 45, 46 it passes to a cut line (see FIG. 10) defined by the path of travel of a horizontally movable rotary cutter 52 forming part of the cutting means 12. The cutter 52 is a driven rotary cutter which is suitably mounted on a chain and sprocket device 53 driven by motor 54 to move back and forth transversely across the material M for transversely cutting the material M into individual pieces L for continued fabrication of individual pillowcases P.

If "regular cut" pillowcases P are being fabricated, the end of the material M is placed approximately 1 inch pass the cut line of the rotary cutter 52 to allow for a small trim-off to obtain a straight edge prior to automatic operation of the apparatus. If "panel cut" pillowcases P are being fabricated, the material M is placed to the cut line so that, when trimmed-off, the proper distance from the cut edge to the panel print design D will be provided.

The apparatus has now been threaded up and is ready for automatic run, as will be discussed below in a description of the electrical sequence. When the desired lengths of material M has been fed for either a "regular cut" or "panel cut" pillowcase P, the nip-feeding rolls 45, 46 will automatically stop in a manner to be described below. When the nip-rolls 45, 46 stop, a top clamp 60 which is carried by a pneumatically-operated piston and cylinder mechanism 61 mounted on frame portion F2, (see FIGS. 4 and 10) is activated to clamp the material M against a stationary plate 63 on the frame portion F2 to hold the material M just below the cut line of the rotary cutting mechanism 52. At the same time, the rotary cutting mechanism 52 is activated which causes the cutting mechanism to move across and cut the material M to form an individual piece L which is held at the top cut edge E1 by the clamp 60.

After the piece L has been cut, a bottom clamp 65, carried by a pneumatic piston and cylinder mechanism 66 on the frame portion F2, clamps the cut piece L against a stationary plate 67 on the frame portion F2 just below a first belt conveyor 68. This action activates a push-through bar 70 which is carried by a pneumatic piston and cylinder mechanism 71 mounted on the frame portion F2 to push the material M between the first belt conveyor 68 and a top hold plate 73. The top hold plate 73 is pivotally mounted on the frame portion F2 and is moved into and out of clamping engagement with the first conveyor belt 68 by a pneumatic piston and cylinder mechanism 74 mounted on the frame portion F2. As the push-through bar 70 starts to extend, it deactivates the top clamp 60 thereby releasing the top cut edge E1 of the cut piece L. This will allow the push-through bar 70 to push the cut edge E1 of the piece L through the belt conveyor 68 and top hold clamp 73 to extend approximately one inch past the belt conveyor 68.

As the push-through bar 70 retracts after pushing the cut edge E1 of the cut piece L through the first belt conveyor 68 and top hold plate 73, it activates the top hold plate 73 which comes down and clamps the top cut edge E1 of the piece L to the belt conveyor 68. This belt conveyor 68 is mounted on a portion of the machine frame F3 (see FIGS. 5 and 6) by suitable pulley mechanisms and is continuously driven in a manner to be described below. With the top hold plate 73 down, the bottom hold clamp 65 is deactivated and the cut piece L now begins to move in a second, generally straight-line, path of travel at a generally 90° angle to the first path of travel of the material M prior to being cut. The cut piece L is positioned, as described above, to hang downwardly from the belt conveyor 68 in a generally vertically-extending position so as to conserve space and provide a more compact apparatus.

When the trailing end of the cut piece L has moved away from the cutting means 12, the top hold plate 73 is deactivated by the piston and cylinder mechanism 74 moving the top hold plate 73 back to its upward position. The next cut piece L in the sequence is then pushed through the belt conveyor 68 and top hold plate 73, as described above, after having been cut and clamped by the respective mechanisms. The cut pieces L are spaced approximately four inches apart sequentially as they are fed forwardly by the first belt conveyor 68. The sequence continues to repeat itself to sequentially place cut pieces L in the above described position for being fed forwardly in the above described path of travel.

A second belt conveyor 75 is positioned to cooperate with the first belt conveyor 68 (see FIGS. 1 and 6) to receive the clamped end E1 of the cut piece L between it and the first belt conveyor 68 as each cut piece L is fed forwardly sequentially in its path of travel. The second belt conveyor 75 is in the form of an endless belt and is suitably mounted by pulley mechanisms carried by the frame portion F3 and is continuously driven in a manner to be described below.

The stitching means 14 is a suitable sewing machine mounted adjacent the belt conveyors 75 and 68 so that the clamped end E1 of the cut pieces L are trimmed and stitched as they sequentially pass the sewing machine 14. A chain of stitching is produced between cut pieces L which is cut by an automatic chain thread clipper 77 located at the exit end of the sewing machine 14. This clipper 77 is activated by the trailing edge of each cut length, in a manner to be described below.

After the cut pieces L have been sewed and the stitch chains cut, the pillowcases P have been formed. The pillowcases P then continue in their sequential path of travel by the second belt conveyor 75 which now has clamped the sewn and cut end E1 of the pillowcase P against a plate 79 carried by the frame portion F3.

The pillowcases P then move sequentially in front of an air doffing mechanism 80 that automatically doffs the pillowcases P over a bar 82 of the accumulating stacking means 15 by blowing the pillowcases P from the conveyor 75 and plates 79 and over the bar 82 (indicated schematically in FIG. 2), in a manner to be described more fully below. The air pressure on the air doffing mechanism 80 can be regulated to allow for different lengths of pillowcases P and is controlled in a manner to be described below.

The accumulating and stacking means 15 further includes numerous bar holders 82 carried by respective pairs of driven chains 84, 85. The accumulating and stacking mechanism 15 provides for the stacking of approximately 60 pillowcases P over a bar holder 82 by the air doffing mechanism 80 and is then advanced. This moves the full bar 82 from the stacking section, composed of chain drives 85, to the accumulating section, composed of chain drives 84, and brings up an empty bar 82 on which the next stack of pillowcases P will be doffed. This procedure continues as long as the machine is running and the accumulating section will hold approximately 11 stacked bundles.

Referring now particularly to FIGS. 11 and 12A–12D, an electrial sequence of operation will be described. The main power supply 101 to the machine is 220 VAC, 3 Phase, 60 hz and is fed through a 15 Amp circuit breaker 102. Power is then fed to a magnetic starter 103 which is pulled in when the operator depresses an "Enable" push button switch 104. This "Enable" switch 104 puts power on the entire electrical system.

The apparatus is threaded up with material M, as described above. The scray nip-rolls 26, 27 are driven by the motor 24, as described above, which is a ¼ H.P., 220/115 VAC, 1 phase gear motor controlled through the pivot action of the scray mechanism and the proximity switch 33. The sequence described above repeats itself as long as the apparatus is running.

Opening and closing of the nip-rolls 45, 46 for threading is controlled by a push button switch 106 (FIG. 12B) which, when depressed, applies power to solenoid valve 107 to control air to the piston and cylinder mechanism 47 for pivoting the nip-roll 46 into closed position with the nip-roll 45. When the push button switch 106 is retracted, the solenoid valve 107 is deenergized causing the piston and cylinder mechanism 47 to open the nip-roll 46 with respect to the nip-roll 45 for threading-up. The nip-roll 45 is driven by the motor 50 (FIG. 12A), as described above, which is a ¼ H.P., 220/115 VAC, 1 phase gear motor in tandem with a suitable electroid clutch/brake 49. The nip-rolls 45, 46 are driven by energizing the clutch coil of the clutch/brake 49 and stopped by energizing the brake coil of the clutch/brake 49, as will be described below.

After the apparatus has been threaded up with material M, the operator depresses a "Start" push button switch 110 (FIG. 12B) which energizes and latches in coil relays 112, 113, 114. Coil relays 112 and 113 are latched in through the machine "Stop" push button switch 115, coil relays 116 and 117. With relays 112 and 113 energized, power is supplied to motor 120 and motor 121. The motor 120 drives the first belt conveyor 68 and the motor 121 drives the second belt conveyor 75 (see also FIGS. 2 and 10). These motors 120, 121 continue to run until either the operator depresses the "Stop" switch 115 or other events occur, as will be described below. Relay 114 is latched in through a magnetically actuated, microswitch 123 which is located on the top hold clamp piston and cylinder 61 (schematically illustrated in FIG. 11). At this point in the cycle, the top hold clamp 60 is retracted magnetically holding microswitch 123 closed. This function served by microswitch 123 is used only in the initial startup of the cycle and once the apparatus is in automatic cycle, microswitch 123 serves no purpose, as described more fully below. With relay 114 energized, power is applied to solenoid valve 125 (FIG. 12C) which causes the bottom hold clamp 65 to retract by operation of the piston and cylinder mechanism 66.

Figure 12A:
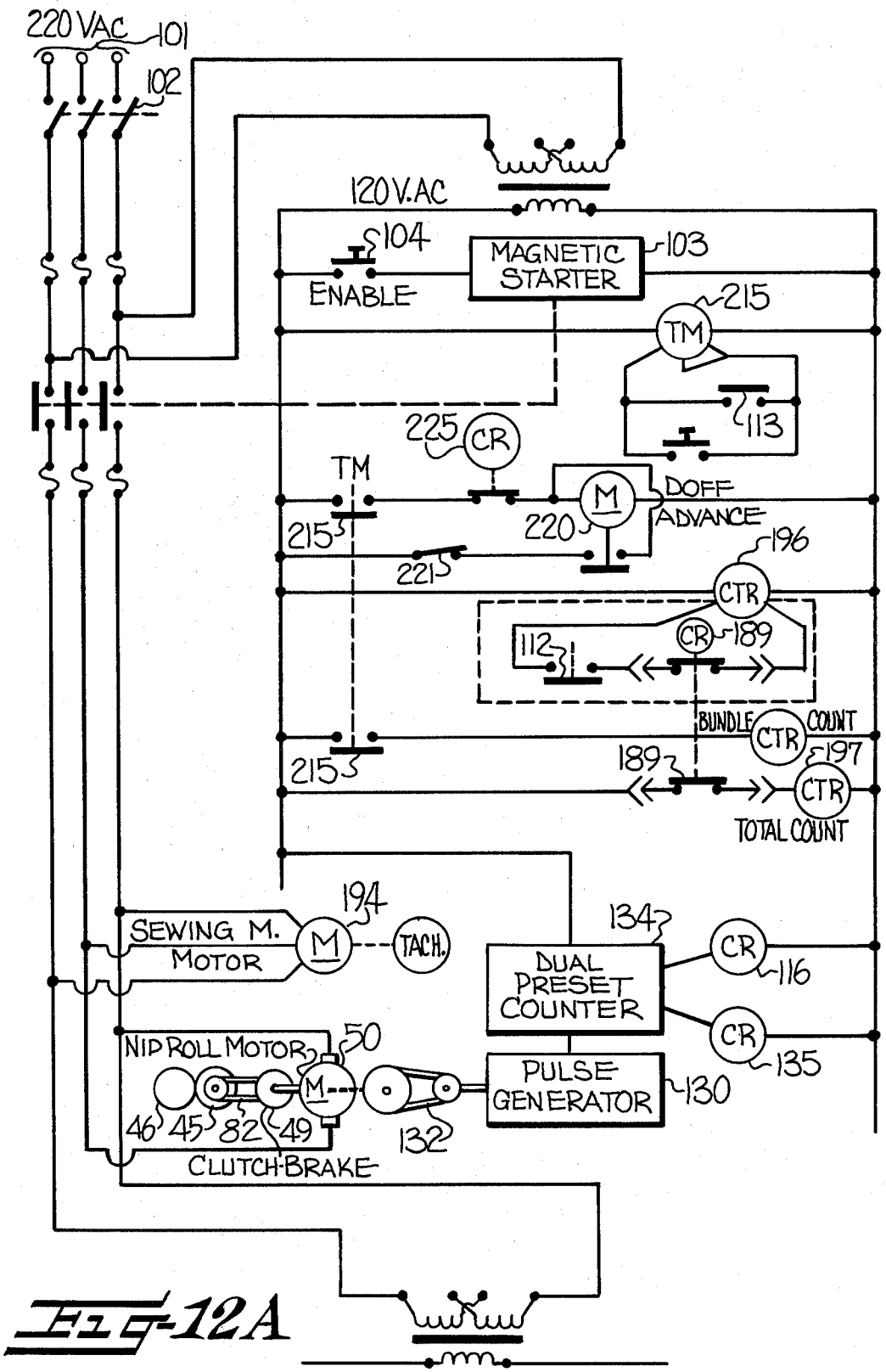

The apparatus is now ready to set up for fabricating either "regular cut" or "panel cut" pillowcases P. For this purpose, the desired length of the cut lengths L and ultimate pillowcases P must be set up. In either case, the nip-rolls 45, 46 are used as a measuring device to determine the dimension of the length of the cut pieces L. This is accomplished through a suitable, commercially available, rotary pulse generator, schematically indicated at 130 (FIG. 12A). The rotary pulse generator 130 produces 600 pulses per input revolution and is driven through a 2/1 ratio from the motor 50, also driving the feeding nip-rolls 45, 46, by a suitable belt and pulley drive 132 to produce 1,200 pulses per revolution of the feeding nip-rolls 45, 46. This means that, as the feeding nip-rolls 45, 46 feed material M, 0.0107 inch of material M is fed per pulse produced by the pulse generator 130. These electrical pulses are fed to a suitable commercially available, dual adjustable preset output, pulse counter 134 which can be preset for fabricating either "regular cut" or "panel cut" pillowcases P.

To preset for fabricating "regular cut" pillowcases P, a number is programmed into the number one output preset of the pulse counter 134 which is equivalent to the finished length of the particular size pillowcase P being fabricated. This number represents the number of electrical pulses from the pulse generator 130 required to feed the desired length of material M past the cutter means 12. This number is lower than the actual number representing the finished length of the pillowcase P. For example, to cut the material M into a piece L for a pillowcase P which is 36 inches long, the actual number of pulses representing 36 inches is 3,365. A preset of approximately 2,950 pulses is required for such a finished length of a pillowcase P of 36 inches. This difference in the number of pulses is due to the reaction time for the relays involved and the brake of the clutch/-brake mechanism 49 to actually stop the feeding nip-rolls 45, 46 from feeding material M. When the pulse counter 134 receives enough pulses to reach this preset number, the number one output of the pulse counter is energized which energizes coil relay 135. The function of relay 135 to fabricate "regular cut" pillowcases P will be discussed below.

A number is also programmed into the number two output preset of the pulse counter 134 that represents the maximum allowed length of material M that may be fed for cutting a piece L for a particular size pillowcase P. This number represents the actual maximum length allowed. No allowance for reaction time is needed. If the pulse counter 134 receives enough pulses to reach this second preset number, the number two output of the pulse counter is energized which in turn energizes relay 116. If this happens, the apparatus will stop since one of the contacts of relay 116 is in series with the "Stop" push button switch 115 (FIG. 12B) and acts to shut off power to the apparatus when energized. A suitable indicator light may be provided to light up when the apparatus is stopped and the operator must then make corrections to the number one output preset of the electrical pulse counter 134 to correct this excessive length situation.

To set up for fabricating "panel cut" pillowcases P, a number is programmed into the number one output preset of the electrical pulse counter 134 that represents the portion of the printed panel design D on the material M which the scanning device 43 is not to read. For example, (see FIGS. 1 and 2) the portion which the scanning device 43 is not to read would be that portion between printed panel designs D in the continuous material M. The operator must measure the portion not to be read by the scanning device 43 and convert the number of inches into equivalent number of electrical pulses produced by the pulse generator 130 for feeding that length of material M. This number of electrical pulses is then programmed into the number one output preset of the pulse counter 134. As in the set up for "regular cut" pillowcases P, when the electrical pulse counter 134 has received enough pulses to reach this preset number, the number one output of the counter 134 is energized which in turn energizes coil relay 135, the function of which will be discussed below. The procedure for setting up the number two output preset of the electrical pulse counter 134 for fabricating "panel cut" pillowcases P is identical to that discussed above for fabricating "regular cut" pillowcases P. The results of the electrical pulse counter reaching output preset two in fabricating "panel cut" pillowcases P are the same for fabricating "regular cut" pillowcases P, discussed above.

After the desired length of cut pieces L has been set up, in the manner discussed above, the apparatus is ready for automatic cycle. To start the automatic cycle, the operator closes the "Automatic Run" push button switch 140 (FIG. 12B) which completes a series circuit through a magnetically actuated, microswitch 141 positioned to be closed by the bottom clamp 65 being retracted in the manner discussed above (FIG. 11). This series circuit starts the feed of the material M by activating coil timing relay 142 which controls coil relay 143 for fabricating "regular cut" pillowcases P and coil relay 144 for fabricating "panel cut" pillowcases P.

If the apparatus is set up for fabricating "regular cut" pillowcases P, the output of a set of timed contacts in timing relay 142 is routed to relay 143 and coil relay 145 through push button switch 147 (FIG. 12B), which is closed for fabricating "regular cut" pillowcases P and energizes these relays. Relays 143 and 145 are then latched in through relay 135, which is controlled by the number one output of the dual preset electrical pulse counter 134. When relay 143 is energized, the clutch coil of the clutch/brake 49 is energized to start the feeding operation of the nip-rolls 45, 46. When relay 145 is energized, the brake coil of the clutch/brake 49 is open. When the preset number of the number one output of the electrical pulse counter 134 is reached, relay 135 is energized which releases the latch on relays 143 and 145. When relay 143 deenergizes, the clutch coil of the clutch/brake 49 opens and when the relay 25 deenergizes, the brake coil of the clutch/brake 49 energizes stopping the feeding operation of the nip-rolls 45, 46. The desired length of a piece L has now been fed.

Figure 12B:
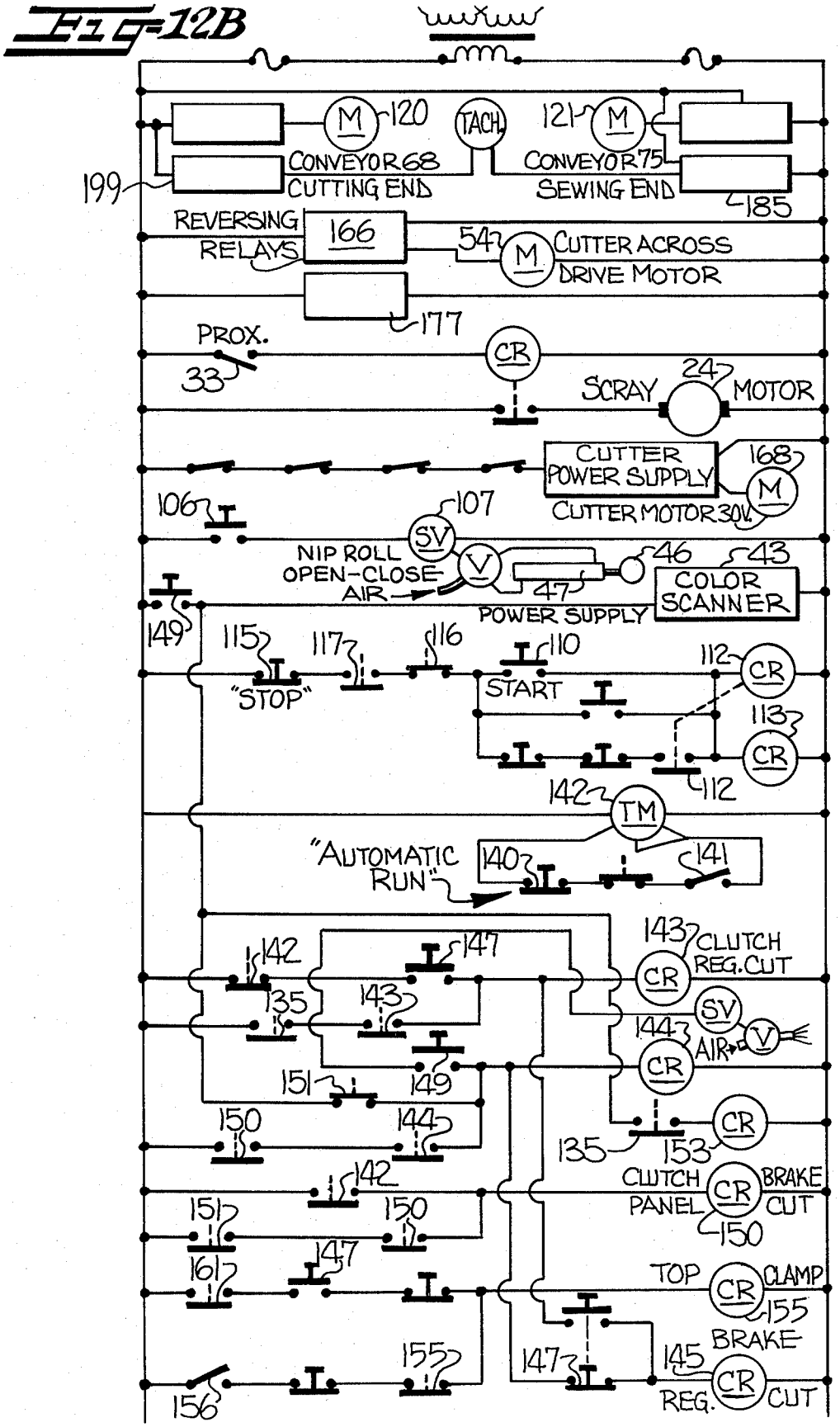
Figure 12C:
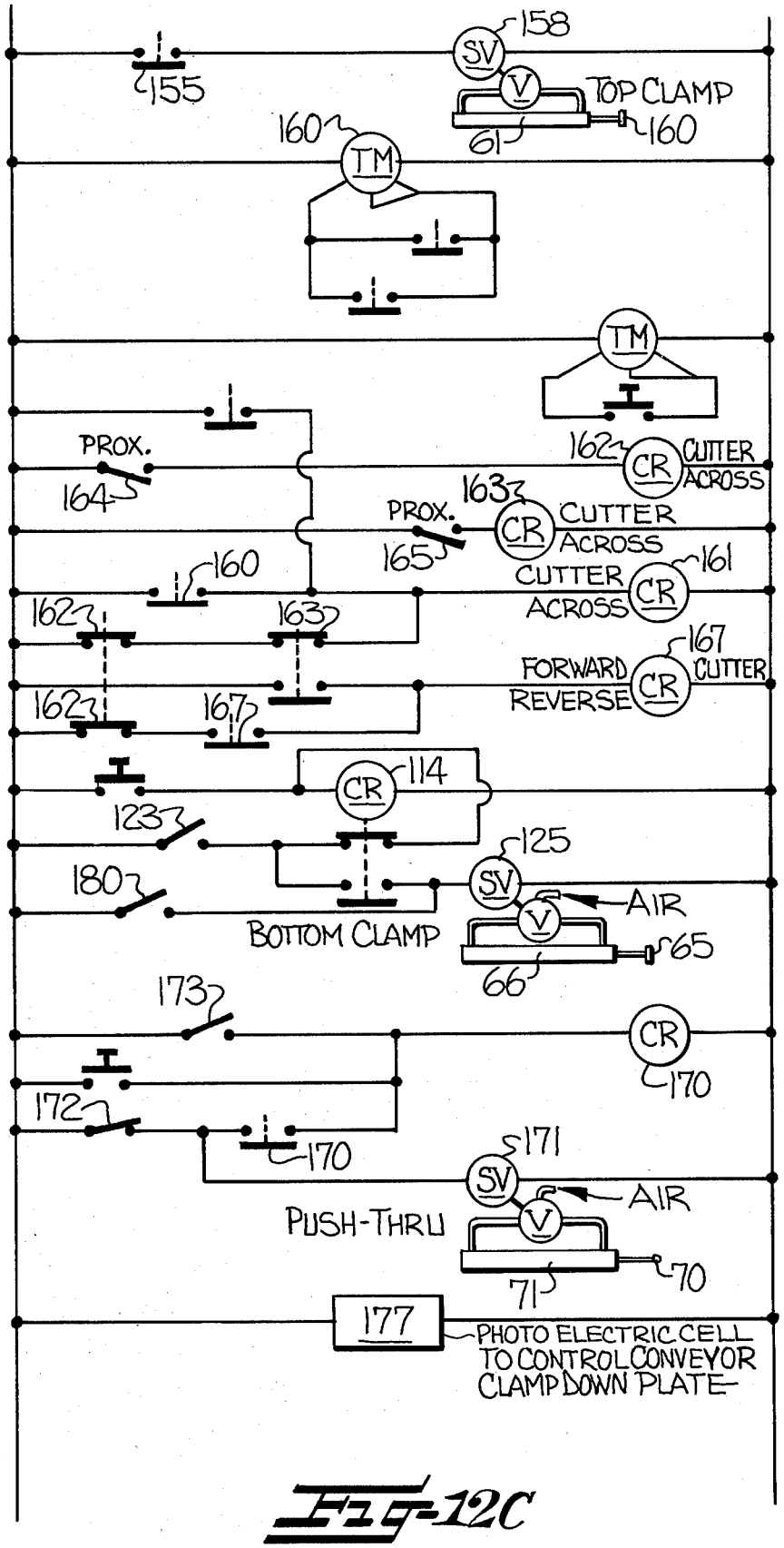
Figure 12D:
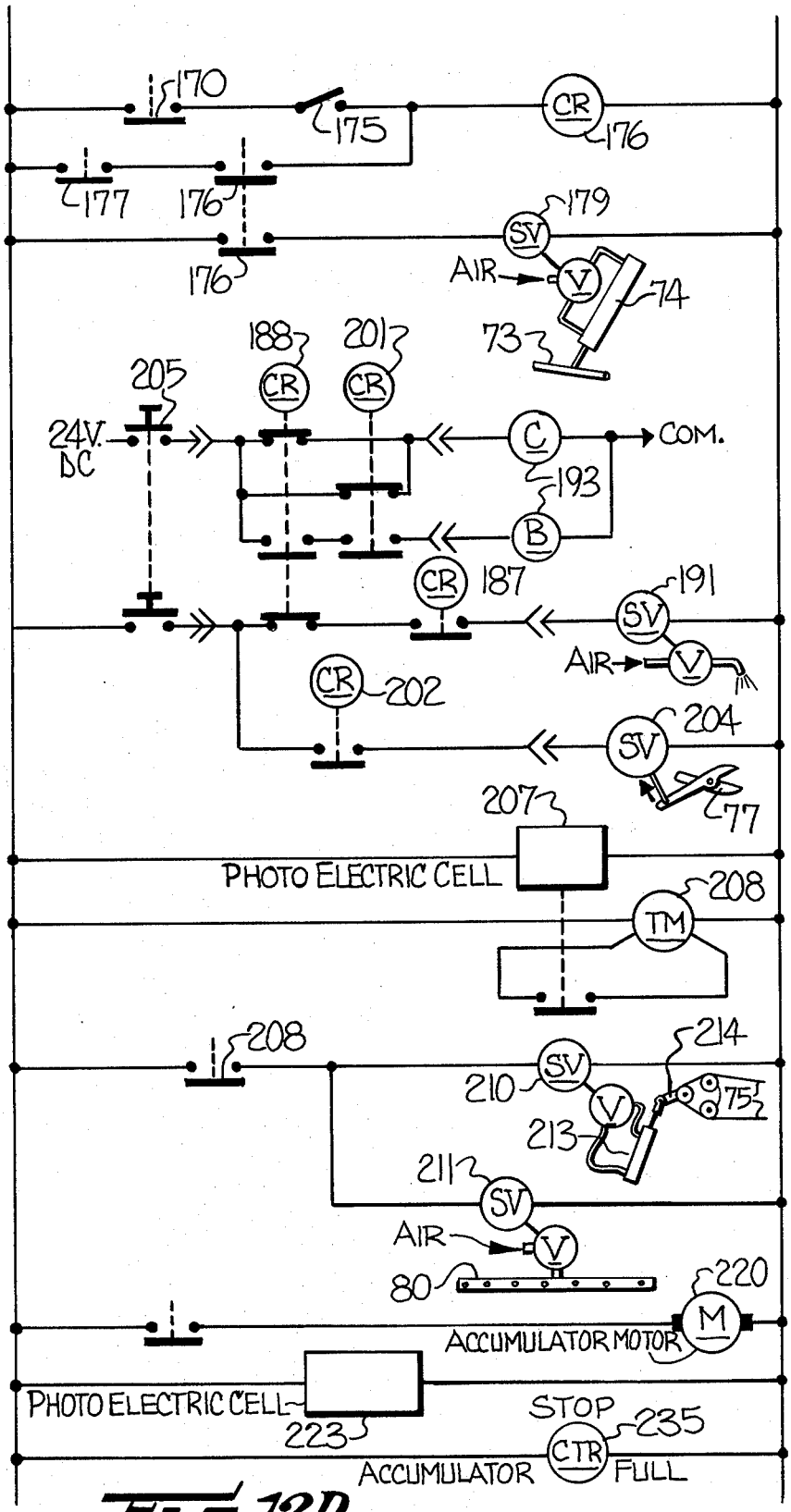

If the machine is set up for fabricating "panel cut" pillowcases P, the output of the same set of timed contacts as used for fabricating "regular cut" pillowcases P is routed to relays 144 and 145 through push button 149 (FIG. 12B), which energizes these relays. Relays 144 and 145 are then latched in through coil relay 150 at this point of the cutting cycle. Relay 150 is energized at the same time relay 144 is energized by a separate set of timed contacts in timing relay 142. Relay 150 is then latched in through coil relay 151 located in the scanning device 43 power supply (FIG. 12B). Coil relay 151 is controlled by the scanning device 43 reading a color or shade contrast on the material M. The color or shade scanning device 43 is a well understood, commercially available mechanism. With relay 144 energized, the clutch coil of clutch/brake 49 closes starting the drive to the feeding nip-rolls 45, 46.

After the desired length of material M has been fed to reach the number one preset of the pulse counter 134, relay 135 is energized by the number one output of the electrical pulse counter 134. Relay 135 energizes a coil relay 153 for the same set time. The contacts in relay 153 control a latch and inhibit module mounted inside the scanning device 43 power supply. Until relay 153 is energized, the scanning device 43 is inhibited from reading a color contrast and relay 151 is latched in an energized state. When relay 153 is energized for the time duration and then released, the latch and inhibit function of the scanning device 43 is released and the scanning device will now be able to read a color or shade contrast. The latch on relay 151 was released when the latch and inhibit module function was released and in turn released the latch on relay 150. At this point, the latch on relays 144 and 145 are maintained through relay 151. The clutch coil of clutch/brake 49 remains energized and the material M continues to be fed.

When the point on the printed panel design D that is to be read reaches the scanning device 43, the scanning device reads this point and energizes relay 151. The latch on relays 144 and 145 are released and the relays deenergized. The clutch coil of clutch/brake 49 is now opened and the brake coil of the clutch/brake 49 closes causing the feeding nip-rolls 45, 46 to stop feeding material M. When relay 151 was energized by the scanning device 43 reading the printed design D, the latch and inhibit module function of the scanning device 43 was again applied which latches in relay 151 and inhibits the scanning device 43 from reading again until the function is removed on the next cycle. The desired length of material M for a cut piece L of a "panel cut" pillowcase P has now been fed by the feeding nip-rolls 45, 46 to the desired length.

The material M is now ready to be cut and the cutting cycle consists of activating the top clamp 60 and the rotary cutter 52 as described above. These functions are controlled in two different ways depending upon whether the machine is set up for fabricating "regular cut" or "panel" "cut" P.

With the apparatus set for fabricating "regular cut" pillowcases P, coil relay 155, which controls the top clamp 60 is energized by the momentary signal from relay 135 which is activated when the number of electrical pulses preset into preset number one of the electrical pulse counter 134 is reached. Relay 155 is then latched in through a magnetically actuated, microswitch 156 which is located on the retracted end of the piston and cylinder 71 controlling the push-through bar 70 (see FIG. 11). With the push-through bar 70 in its retracted position, microswitch 156 is magnetically held closed thereby maintaining the latch on relay 155. A set of contacts in relay 155 energizes solenoid valve 158 which controls the pneumatic piston and cylinder 61 for causing the top clamp 60 to go in and clamp the material M to plate 63. Another set of contacts in relay 155 activates coil timing relay 160 from which a set of timed contacts energizes coil relay 161. Relay 161 is then latched in through coil relays 162, 163. Relays 162, 163 are controlled by proximity switches 164, 165 which are located on each end of the cutting stroke of cutter 52 (FIGS. 10 and 12C) and suitably mounted on frame portion F3. Prior to receiving the cut signal, the cutter 52 is located in front of one of the proximity switches 164, 165 thereby maintaining relay 162 or relay 163 energized. With either of these relays energized, the latch circuit on relay 161 is open. When relay 161 receives the timed signal from timing relay 160, the signal must be of sufficient time duration to allow the cutter 52 to move away from the proximity switch 164, or 165 which thereby completes the latch circuit. With relay 161 energized, a run signal is applied to a conventional motor controller 166 which starts up the drive motor 54 to the cutting mechanism 12. Relay 161 will remain latched in until the movable cutter 52 reaches the other side of its cutting stroke. When this happens, the other proximity switch 164, 165 is closed thereby opening the latch circuit on relay 161. The run signal is then removed from motor controller 166 to stop motor 54 and movement of the movable cutter 52.

At this point, relay 155 is still maintained energized holding the top clamp 60 in clamping position. Relays 162, 163 are also used to place the cutter 52 in a forward-reverse movable state. When the cutter 52 is in front of proximity switch 165, coil relay 167 is energized through relay 163 which is controlled by proximity switch 165. Relay 167 is latched in through relay 162 and places motor controller 166 in a forward drive state. When the motor controller 166 is signalled to start the cutting mechanism drive motor 54, it drives in a forward direction. When the cutter 52 reaches the other side and closes proximity switch 164, relay 162 is energized which, as stated above, stops the cutter assembly drive and also opens the latch on relay 167. This places motor controller 166 in a reverse drive state. On the next cutting cycle, the movable cutter 52 will return to the other side.

With the apparatus set up for fabricating "panel cut" pillowcases P, relay 151 was energized when the scanning device 43 read the beginning of panel design D and activated timing relay 160 which energized relay 161 in the same fashion and for the same operation as described above with respect to fabricating of "regular cut" pillowcases P. Relay 155 is energized by a set of contacts in relay 161, instead of relay 135 as was the case in fabricating "regular cut" pillowcases P. Relay 135 is out of this circuit controlling the top clamp 60 by means of push button switch 147. The latch on relay 155 is identical to that described above with respect to fabricating of "regular cut" pillowcases P. The forward-reverse circuit motor controller 166 remains the same as described above with respect to fabricating of "regular cut" pillowcases P.

Figure 10:
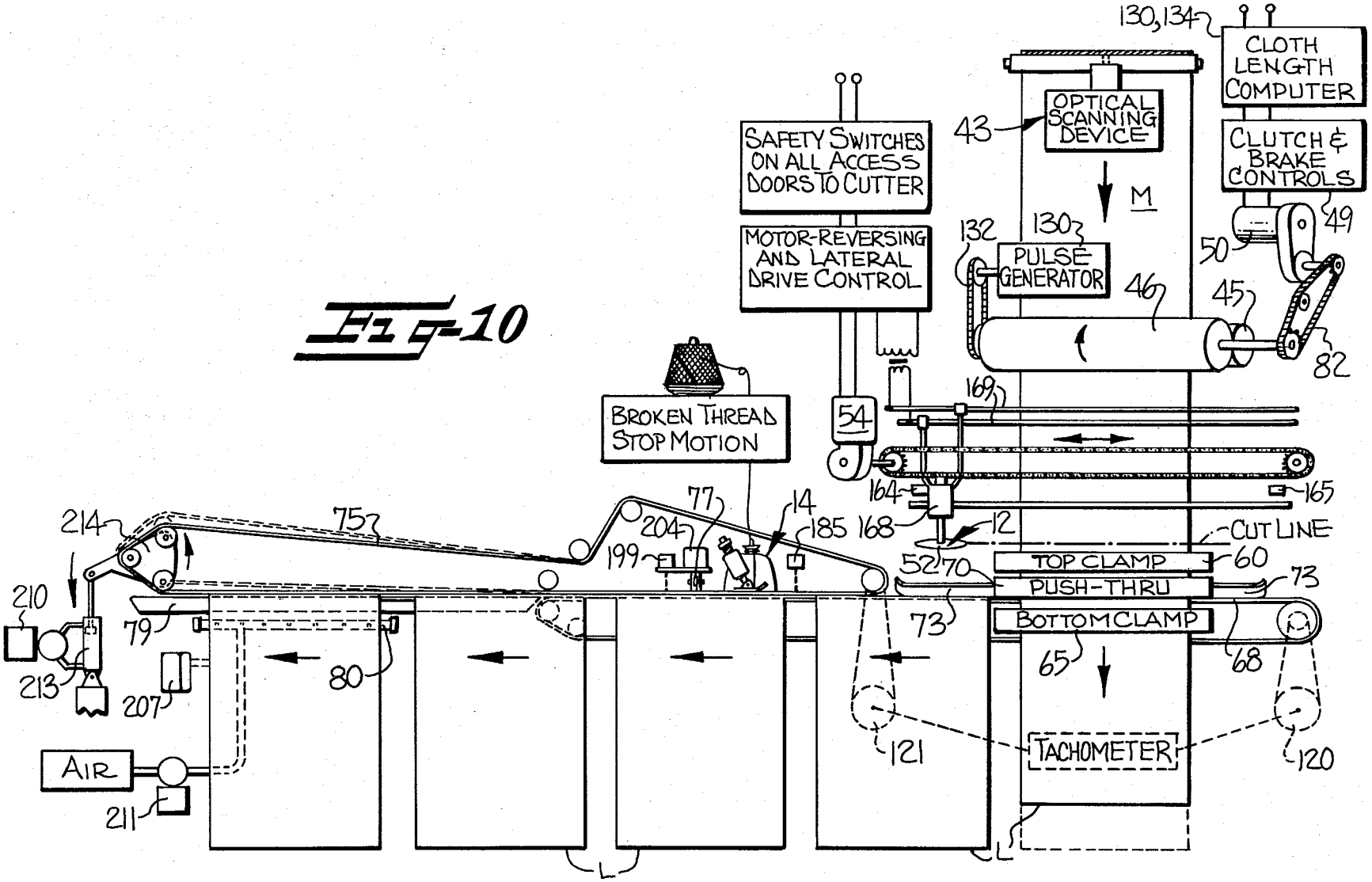
FIG. 10 is a schematic mechanical/electrical view of a portion of the apparatus illustrated in FIG. 2.

In fabricating of either "regular cut" or "panel cut" pillowcases P, the movable cutter 52 itself is driven by a 24 VDC motor 168. A 24 vdc power supply supplies power to bus bars 169 carried by the frame portion F3 along the length of the cutting stroke of the movable cutter 52 (FIG. 10). A brush assembly 166 travels these bus bars 169 and feeds the power to the motor 168. This motor 168 runs continuously as long as the "Enable" push button switch 104 is depressed and all access doors of the frame assembly F3 are closed. These access doors to the frame assembly providing access to the cutting means 12 have limit switches attached to them and the doors must be closed before the cutting means 12 will run. This is a safety feature designed into the apparatus.

After the material M has been cut sequentially into pieces L, as described above, these lengths L are ready to be carried to the stitching means 14 by the first belt conveyor 68. As described above, relay 114 was energized by closing of the "Start" push button switch 110 and latched in through microswitch 123 located at the retracted end of the pneumatic piston and cylinder 74 of the top clamp 73. When the top clamp 73 moves into clamping position, solenoid valve 158 is energized by relay 155. At this time, microswitch 123 is allowed to open thereby releasing the latch on relay 114. With relay 114 deenergized, the bottom clamp 64 goes in and clamps the material M against stationary plate 67 just below the first belt conveyor 68. The cut piece L is now clamped above and below the push-through bar 70. When the bottom clamp 65 clamps the cut piece L to the stationary plate 67, magnetically actuated, microswitch 172, which is located on the extended end of the piston and cylinder 66 of the bottom clamp 65 (FIG. 11), closes placing power through a set of normally closed contacts in coil relay 170 to solenoid valve 171. With solenoid valve 171 energized, pneumatic pressure is applied to the piston and cylinder 71 to extend the push-through bar 70.

When the piston and cylinder 71 is extended, magnetically actuated microswitch 156 on the retracted end of the piston and cylinder 71 (FIG. 11) is opened thereby releasing the latch on relay 155. With relay 155 deenergized, the top clamp 73 is retracted. The top edge of the cut piece L is now free to be pushed through by the push-through bar 70. When the push-through bar piston and cylinder 71 is fully extended and has the cut end of the cut length L pushed through between the conveyor belt 68 and top plate 73, magnetically actuated microswitch 173, which is located on the extended end of the push-through bar pistion and cylinder 71, closes energizing relay 170. Relay 170 is latched in through microswitch 169. The set of normally closed contacts in relay 170 that energized solenoid valve 171 are now open and the solenoid valve 171 is deenergized. This retracts the piston and cylinder 71 and the push-through bar 70. As the piston and cylinder 71 retract, magnetically actuated, microswitch 175, which is located at the midstroke of the piston and cylinder 71, is momentarily closed which energizes coil relay 176.

Microswitch 175 was closed when the piston and cylinder 71 extended, but a set of normally open contacts between the switch and relay 176 prevented relay 176 from energizing on the extension stroke. Relay 176 is then latched in through switch contacts of photoelectric cell device 177, which is mounted on the frame portion F3 and located above the point where the cut edge of the cut piece L is pushed through the belt conveyor 68 and the top plate 73. When this cut edge was pushed through, the cut piece L broke the beam in the photoelectric cell device 177, thereby closing its contacts and providing a latch on relay 176. With relay 176 energized and latched, solenoid valve 179 is energized (see FIG. 11) to extend piston and cylinder 74 for moving top plate 73 into clamping engagement with the first conveyor belt 68. Magnetically actuated microswitch 180, which is located on the extended end of the piston and cylinder 74 of the top plate 73, is closed by the clamping action of the top plate 73 and energizes solenoid valve 125 to operate piston and cylinder 66 for retracting the bottom hold clamp 65.

It should be noted here that from this point on in the automatic cycle of the apparatus microswitch 180 alone controls bottom clamp solenoid valve 125. As discussed above, relay 114 was used through microswitch 123 to operate the bottom clamp 65 in the initial machine start-up. After initial start-up, relay 114 and microswitch 123 will not be used again until the apparatus is stopped and has to be restarted.

With the top plate 73 in clamping position with the first belt conveyor 68, and the bottom clamp 65 retracted, the cut pieces L are then fed to the stitching means 14. It should be further noted that, when the bottom clamp 65 is retracted, magnetically actuated microswitch 182, located at the midstroke of the bottom clamp piston and cylinder 66 was closed momentarily to reset a commercially available counter 183 (FIG. 11), which will be discussed more fully below. When the bottom clamp 65 and piston and cylinder 66 are fully retracted, microswitch 141 is closed to again start the next cutting cycle. As the cut pieces L, clamped between belt conveyor 68 and plate 73 and hanging in a generally vertical position, are conveyed toward the stitching means 14, the trailing edge of the cut length L moves away from photoelectric cell device 177. When the beam of this photoelectric cell device 177 is completed, the latch of relay 176 is removed and solenoid valve 179 is deenergized allowing the top plate 73 to come up and release its clamping engagement. This movement of top plate 73 opens microswitch 180 energizing solenoid valve 125 which extends piston and cylinder 66 to extend the bottom clamp 65. Prior to the time that the trailing edge of the cut piece L reached photoelectric cell device 177, material M had been fed past the rotary cutter 52 to the desired length, clamped by the top clamp 73, cut by the cutter 52, and is waiting to be clamped by the bottom clamp 65 and pushed through the belt conveyor 68 and top plate 73 by the push-through bar 70 on the next cycle.

Figure 5:
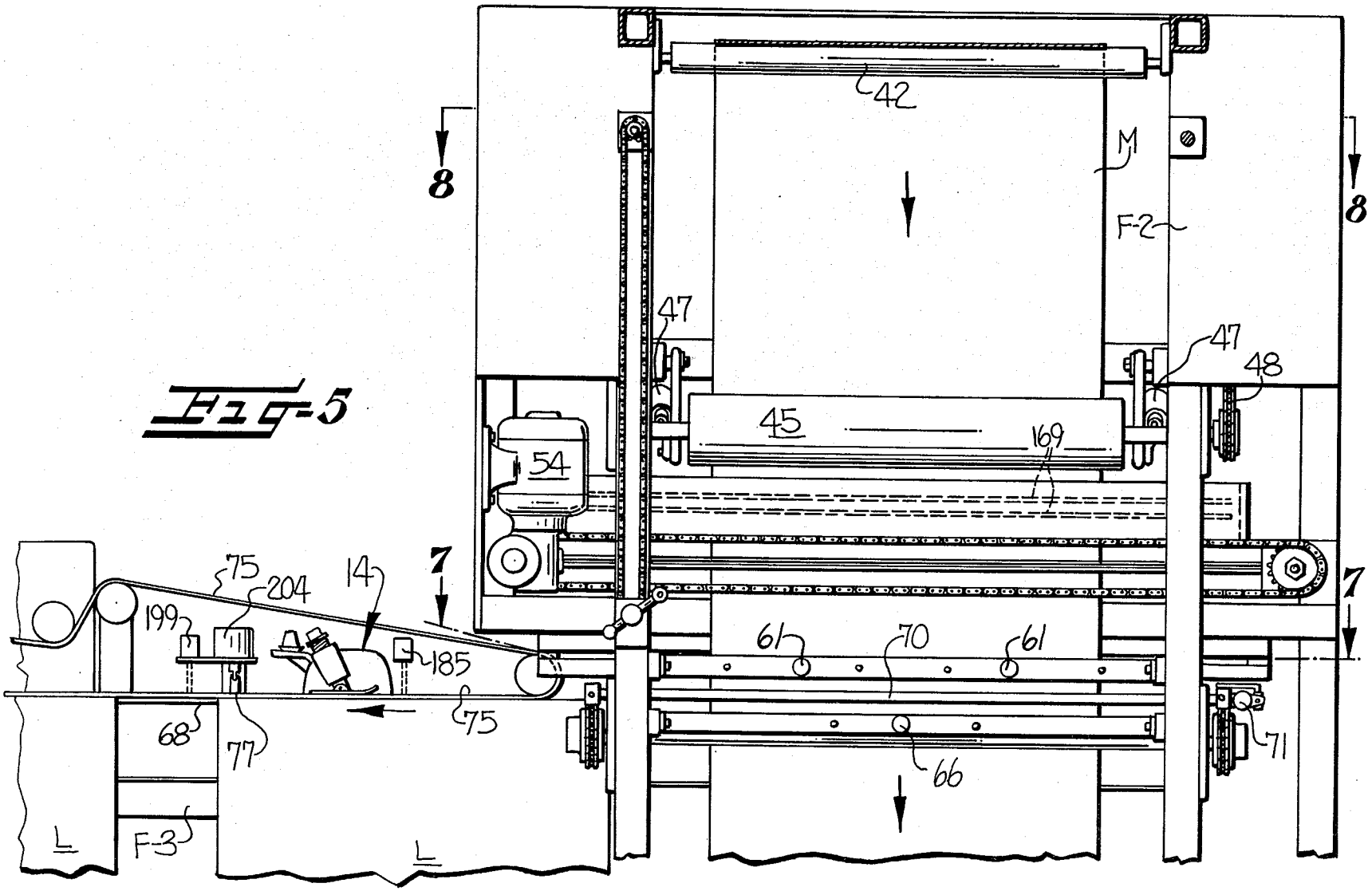
FIG. 5 is a side elevational view of a portion of the apparatus of FIG. 2 and taken in the direction of the arrow 5 in FIG. 4.
Figure 6:
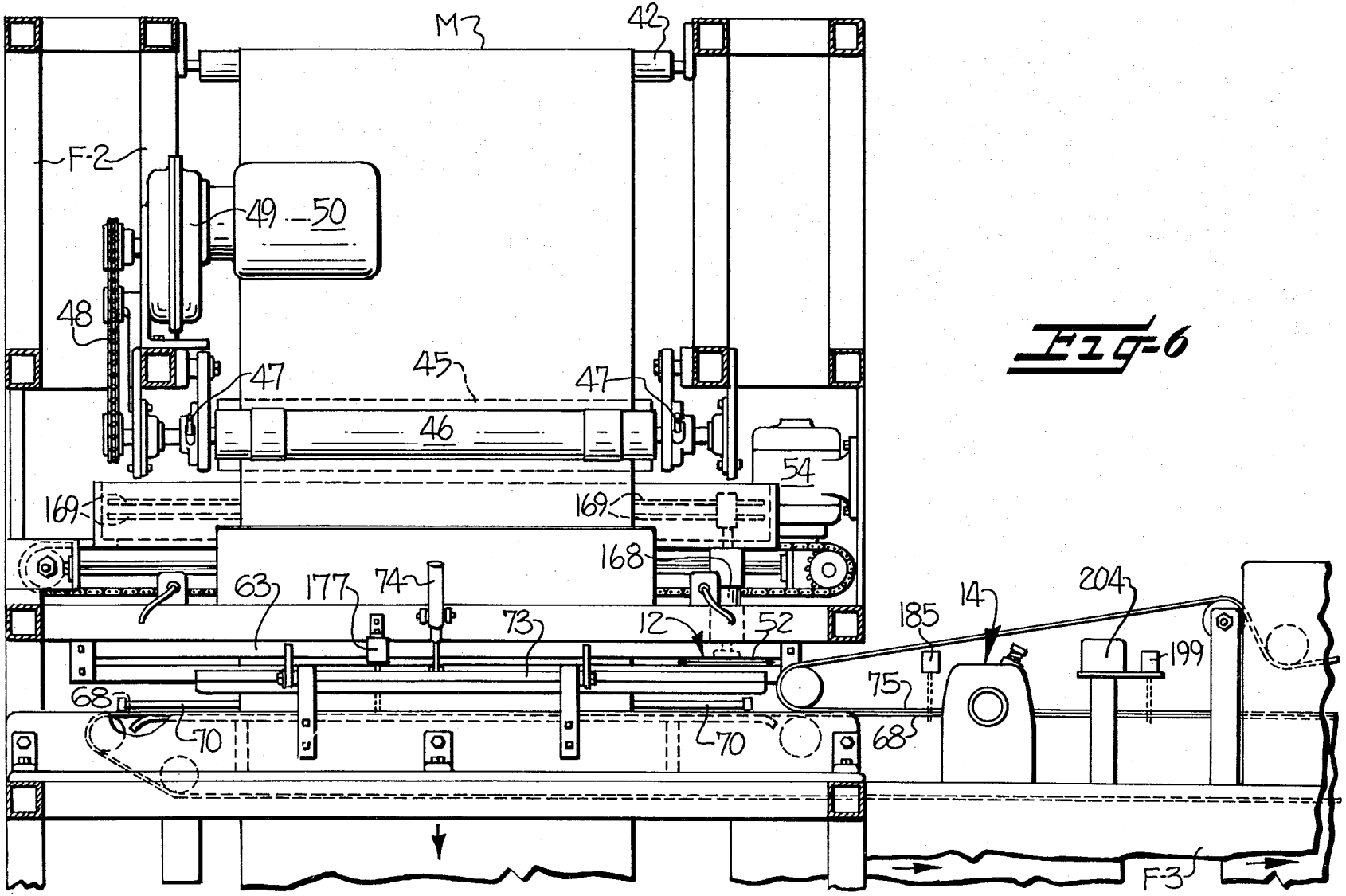
FIG. 6 is a side elevational view of a portion of the apparatus of FIG. 2 and taken generally in the direction of the arrow 6 in FIG. 4.
Figure 7:
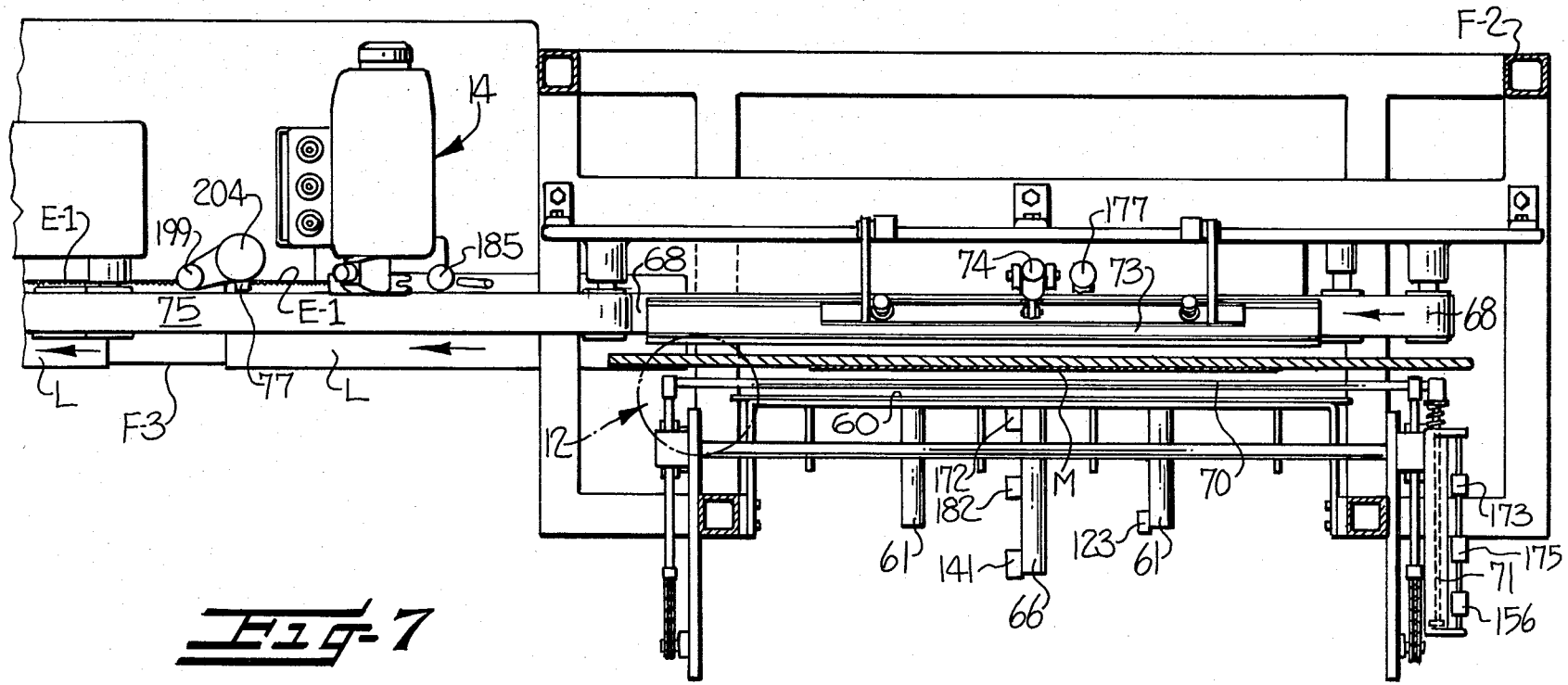
FIG. 7 is a sectional view, taken generally along the line 7—7 of FIG. 5.
Figure 8:
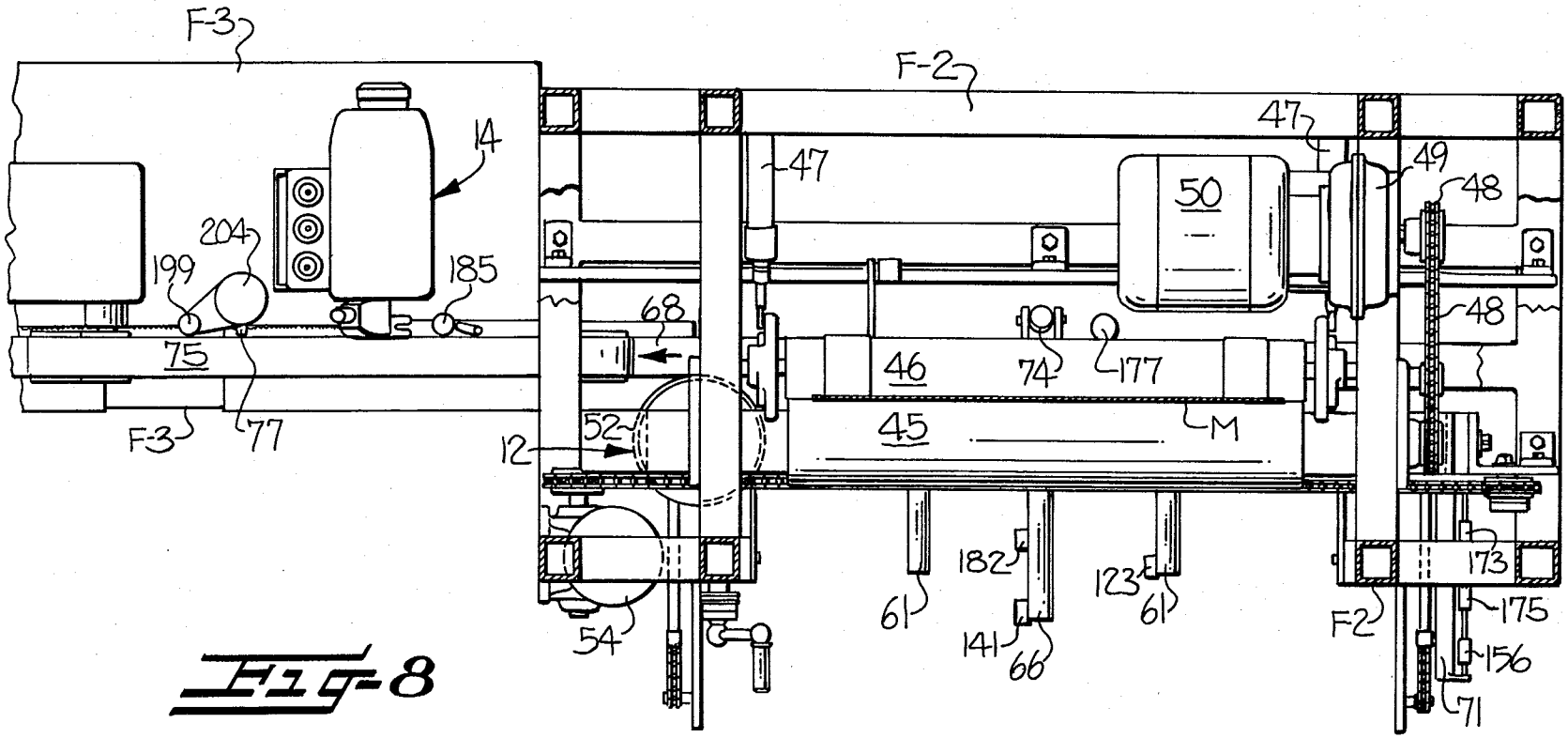
FIG. 8 is a sectional plan view, taken generally along the line 8—8 of FIG. 5.
Figure 9:
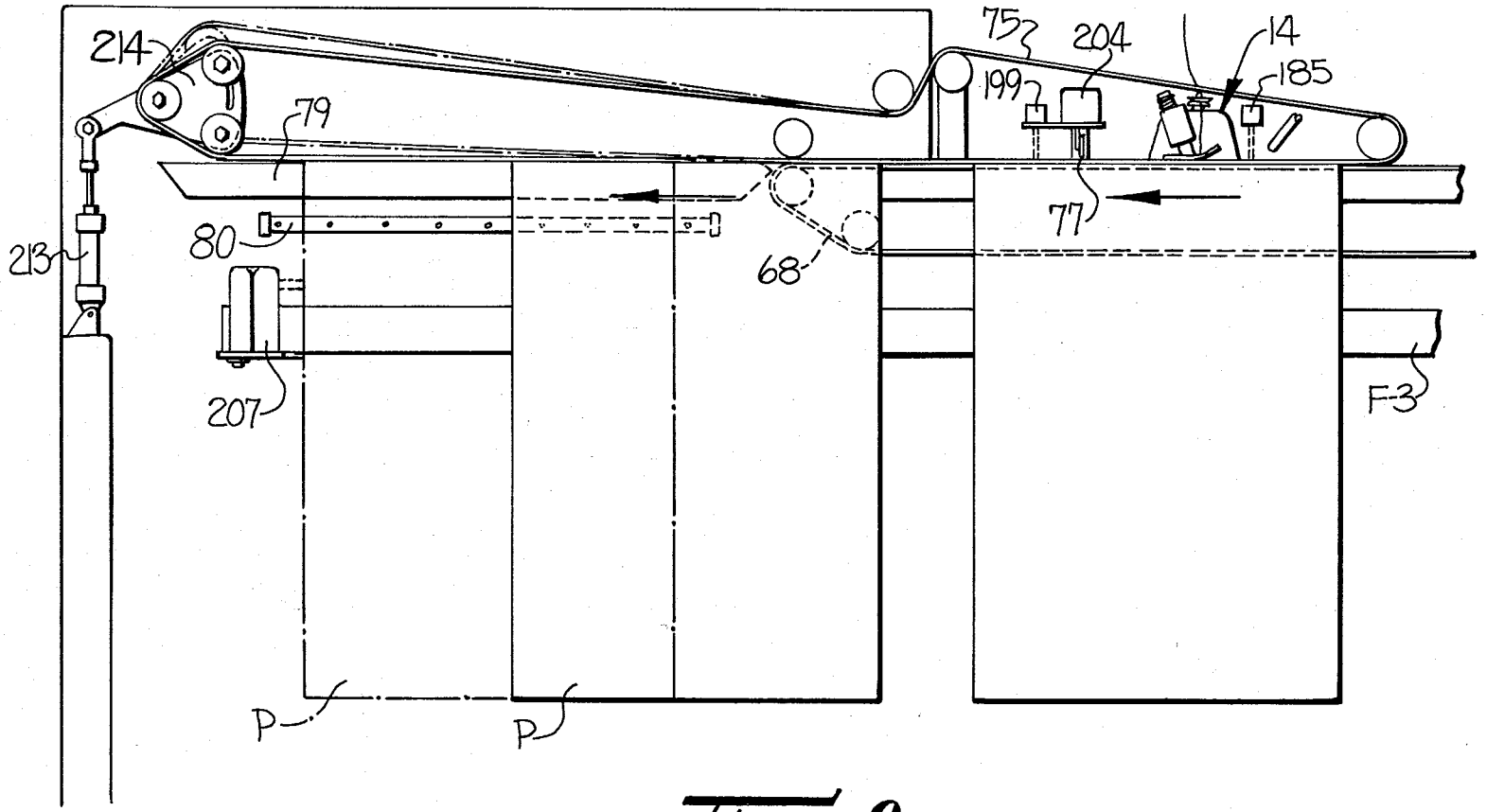
FIG. 9 is an elevational view of a portion of the apparatus of FIG. 2 and taken generally in the direction of the arrow 9 in FIG. 2.

As the cut piece L are sequentially conveyed toward the stitching means 14, the leading edge breaks the beam of a photoelectric cell device 185 suitably mounted on frame portion F3, (FIGS. 5 and 6). This photoelectric cell device 185 controls an electronic circuit that in turn controls three functions. When the beam of this photoelectric cell device 185 is broken, the electronic circuit energizes relays 187, 188, and 189 (see FIG. 12D). Relay 187 controls an air blast that blows down the leading edge of the cut piece L to insure that it goes under the presser foot of the sewing machine 14. This relay 187 energizes for a set period of time and in turn energizes solenoid valve 191 that produces the air blast (shown schematically in FIG. 12D). Relay 188 controls a clutch/brake mechanism 193 (see FIG. 12D) connected with the sewing machine motor 194 (see FIG. 12A). When relay 188 energizes, it energizes the clutch coil of clutch/brake mechanism 193 to start the sewing machine motor 194 running. The sewing machine 14 will continue running as long as the beam of photoelectric cell device 185 is broken. Relay 189 controls counters, to be discussed below, that count the pillowcases P per stack and the total pillowcases P. When this relay 189 is energized, the contacts in the relay provide the switching necessary to activate coil timing relay 196, which controls the counter for pillowcases P per stack, to be discussed below, and coil timing relay 197, which controls a counter for counting the total pillowcases P, to be discussed below.

The cut pieces L continue to move past the sewing machine 14 and the cut end E1 is stitched. As the leading edge of the cut piece L leaves the sewing machine 14, it breaks the beam of another photoelectric cell device 199 suitably mounted on frame portion F3 (see FIGS. 5 and 6). This photoelectric cell device 199 controls another electronic circuit that controls coil relays 201, 202. Relay 201 controls the sewing machine motor clutch/brake 193 on the exit end of the sewing machine 14. The output of this relay is parallel with the output of relay 188 so that the sewing machine 14 will continue to run through its motor 194 until all of the cut pieces L pass the sewing machine 14. When the trailing edge of the cut piece L passes this photoelectric cell device 199 and allows the beam to go back complete, the next cut piece L has already broken the beam of photoelectric cell device 185 on the entering end of the sewing machine 14, thereby maintaining the sewing machine 14 running. If there is no cut piece L advancing when the beam of the photoelectric cell device 199 on the exit end of the sewing machine 14 goes complete, then both beams are complete which activates the brake coil of the clutch/brake mechanism 193 to stop the sewing machine motor 194 and the sewing machine 14.

Relay 202 controls chain thread clipper 77. When the trailing edge of a cut length L that has been stitched passes the photoelectric cell device 199 on the exit end of the sewing machine 14, relay 202 is energized which energizes solenoid valve 204 for activating the chain thread clipper 77 through a cutting stroke. This relay 202 is a timed relay through a suitable resistive-capacitive circuit designed into the electronic circuit. When solenoid valve 204 is energized through relay 202, the clipper 77 clips the chain and then returns to its original position through the timed output of relay 202. The cut pieces L have now been fabricated into pillowcases P which have been cut, stitched, chain clipped and counted and continue to move by the second belt conveyor 75 toward the doffing end of frame portion F3. It should be noted here that if pillowcases P are being run that are to be stitched by sewing machine 14, "Sew/No Sew" push button switch 205 is in a depressed position. This allows all functions described above to operate. If pillowcases P are being fabricated that are not to be stitched, push button switch 205 is in its released position. This allows only the count function to operate since there is no need of the air blast, sewing machine run or thread clipping functions.

After the pillowcases P leave the sewing means 14, the belt conveyor 75 carries the pillowcases P to the doffing end of the apparatus. When the leading edge of a pillowcase P breaks the beam of a photoelectric cell device 207, suitably mounted on the end of the apparatus frame portion F3, the photoelectric cell device 207 activates coil timing relay 208 (FIG. 12D) which energizes solenoid valve 210 and solenoid valve 211. Solenoid valve 210 activates a pneumatic piston and cylinder mechanism 213 (FIGS. 1 and 12D) which pivots a mechanical linkage 214 for moving conveyor belt 75 away from clamping engagement with plates 79 for releasing the clamped cut and stitched end E1 of the pillowcase P for doffing. Solenoid valve 211 activates a suitable valve for supplying air to the doffing mechanism 80, which is in the form of a pipe having apertures therein, for emitting a blast of air therefrom for blowing the pillowcases P over the bar holder 82 of the accumulating and stacking means 15. Solenoid valves 210 and 211 are energized for the time duration set up on coil timing relay 208. This action is repeated for each pillowcase P sequentially received at the doffing mechanism 80 and sensed by the photoelectric cell device 207.

After 60 pillowcases P, which is a desired number for one stack, has been placed on the bar holder 82 of the accumulating and stacking mechanism 15, the full bar 82 is advanced forward and an empty bar 82 is brought up from the bottom of the accumulating and stacking mechanism 15. The number of pillowcases P placed on a bar 82 is controlled by a counter mechanism 196 (FIG. 12A) which may be any suitable, commercially available, well understood counter mechanism. This counter mechanism 196 has a manual preset that determines the number of pillowcases P per bundle. As the counter mechanism 196 receives a count signal from relay 189, as disclosed above, the counter mechanism 196 counts backwards from the manual preset number and when the counter mechanism 196 reaches 0, an internal relay therein energizes which in turn energizes coil timing relay 215 that is electrically connected through the internal relay. The internal relay is energized for a time duration programmed into the counter mechanism 196. The counter mechnism 196 is also wired up to give an automatic reset back to the preset number when 0 is reached.

When timing relay 215 is energized, a set of timed contacts energizes a magnetic motor 220 (FIGS. 2 and 12A) for advancing the chains 84, 85 on the accumulating and stacking section. The holding contacts of motor 220 are held in through proximity switch 221 located on the accumulating and stacking apparatus. With motor 220 energized, the chains 84, 85 will advance the full stack of pillowcases P on the bar holder 82 and bring up a new empty bar holder 82 into doffing position. The motor 220 continues to run until the empty bar 82 reaches proximity switch 221 to indicate that the empty bar 82 is at the proper stopping point. Proximity switch 221, which is normally closed, opens the holding contact circuit in magnetic motor 220 to deenergize and stop the motor 220. This action will repeat again when counter mechanism 196 signals another full stack of pillowcases P.

The accumulating and stacking mechanism 15 will hold a maximum of eleven full stacks of pillowcases P. Ten full stacks will be at the accumulating end of the mechanism 15 and the eleventh stack will be in the process of being stacked at the stacking end of the mechanism 15. When the tenth stack moves to the accumulating end of the mechanism 15, it breaks the beam of a photoelectric cell device 223 that completes the count circuit of counter mechanism 235. At this point, counter mechanism 235 receives a count signal each time timer 160 energizes. When counter mechanism 235 receives enough count signals to reach a preset number in the counter mechanism 235, relay 225 is energized and latched in by the output signal of counter mechanism 235. The contacts in relay 225 open the circuit between timing relay 142 and microswitch 141. This prevents timing relay 142 from energizing again and therefore will not let the drive for the feeding nip-rolls 45, 46 feed further material M for fabricating pillowcase P. The contacts in relay 225 also open the circuit that energizes and latches in the motor 220 for the accumulating and stacking mechanism 15 to prevent the accumulating mechanism 15 from operating when counter mechanism 196 indicates that the accumulating and stacking section is filled. The apparatus will not start up again until the accumulating and stacking mechanism 15 is doffed of at least two stacks of pillowcases P at the end of the accumulating section thereof. This will allow the beam of photoelectric cell device 223 to be complete thereby not letting the counter mechanism 235 count. Counter mechanism 235 must be reset since relay 225 is still energized and latched in preventing the apparatus from running. After counting mechanism 235 has been reset, the apparatus is started back up in the automatic cycle by depressing the "Start" push button switch 110.

In the normal operating cycle, the operator can stop the apparatus by two methods. One by depressing the apparatus "Stop" push button switch 115. This stops all conveyor belt motor drives and the sewing machine drive. The feeding nip-roll drive will finish feeding material M started but will stop after it has been fed to length. This method of stopping is used for such things as jam-ups. Another method of stopping the apparatus is by pressing the "Automatic Run" push button switch 140. This will allow all pillowcases P already in the normal cycle to finish the complete cycle. No other cycles for fabricating pillowcases P will begin and this method of stopping is for such things as machine adjustments, length corrections, color scanning device location changes, standard length changes and changing patterns.

In the drawings and specification, there has been set forth a preferred embodiment of the invention and although specific terms are employed, they are used in a generic and descriptive sense only and not for purposes of limitation.

What is claimed is:

1. Apparatus for sequentially fabricating pillowcases or like product comprising:

means for supplying continuous flat tubular material;

means for transversely cutting the continuous material into individual pieces;

means for feeding the continuous material from said supply means to said cutting means;

means operatively connected with and automatically controlling the operation of said cutting means and said feeding means for sequentially cutting the material into individual pieces of desired predetermined dimensions for the pillowcases;

conveying means for sequentially receiving the individual cut pieces of material, clamping one of the transverse cut ends thereof while allowing the remainder of the cut pieces of material to hang downwardly in a generally vertically-extending position, and conveying the so-positioned cut pieces sequentially in a predetermined path of travel; and means for sequentially stitching the clamped transverse cut end of each piece of material to complete fabrication of the pillowcases while each piece of material is being conveyed by said conveyor means with the remainder of each piece of material in the generally vertically-extending position.

2. Apparatus for sequentially fabricating pillowcases or like products comprising:

means for supplying continuous flat tubular material;

means for transversely cutting the continuous material into individual pieces;

means for feeding the continuous material from said supply means to said cutting means;

means operatively connected with and automatically controlling the operation of said cutting means and said feeding means for sequentially cutting the material into individual pieces of desired predetermined dimensions for the pillowcases, said control means including means for regulating said cutting means and said feeding means for fabricating either regular cut pillowcases in which each pillowcase is cut a predetermined desired length or panel cut pillowcases in which each pillowcase is cut a predetermined desired length from a printed panel design on the pillowcase;

conveying means for sequentially receiving the individual cut pieces of material and conveying the cut lengths sequentially in a predetermined path of travel; and means for sequentially stitching one of transverse cut ends of each of the cut pieces while being conveyed by said conveyor means to complete fabrication of the pillowcases.

3. Apparatus for sequentially fabricating pillowcases or like products comprising:

means for supplying continuous flat tubular material;

means for transversely cutting the continuous material into individual pieces;

means for feeding the continuous material from said supply means to said cutting means;

means operatively connected with and automatically controlling the operation of said cutting means and said feeding means for sequentially cutting the material into individual pieces of desired predetermined dimensions for the pillowcases, said control means including means for regulating said cutting means and said feeding means for fabricating either regular cut pillowcases in which each pillowcase is cut a predetermined desired length or panel cut pillowcases in which each pillowcase is cut a predetermined desired length from a printed panel design on the pillowcase;

conveying means for sequentially receiving the individual cut pieces of material, clamping one of the transverse cut ends thereof while allowing the remainder of the cut pieces of material to hang downwardly in a generally vertically-extending position, and conveying the so-positioned cut pieces sequentially in a predetermined path of travel; and means for sequentially stitching the clamped transverse cut end of each piece of material to complete fabrication of the pillowcases while each piece of material is being conveyed by said conveyor means with the remainder of each piece of material in the generally vertically-extending position.

4. Apparatus, as set forth in claim 1, 2 or 3 further including:

means for doffing the fabricated pillowcases from said conveyor means; and means cooperating with said doffing means for receiving the doffed pillowcases, for stacking the pillowcases into individual stacks of a predetermined number of pillowcases, and for accumulating a predetermined number of stacks for removal by an operator.

5. Apparatus, as set forth in claims 1, 2 or 3, in which said material supply means comprises a pair of friction drive rolls mounted for rotation in side-by-side position for receiving a roll of the continuous flat tubular material on top surfaces thereof and for frictionally rotating the roll of material for unwinding the material, nip-rolls rotatably mounted for feeding the continuous material being unwound, drive means connected with said friction drive rolls and said feeding nip-rolls for rotatably driving said rolls, scray means for receiving the continuous material from said feeding nip-rolls and having counterbalancing means movably mounting said scray means for downward movement under the weight of the material received therein, and control means operatively connected with said drive means and scray means for stopping operation of said drive means, and thus said friction drive rolls and said feeding nip-rolls, when said scray means contains a predetermined amount of material therein and for starting operation of said drive means when said scray means does not contain the predetermined amount of material therein.

6. Apparatus, as set forth in claims 1, 2 or 3, in which said material feeding means comprises selectively driven nip-rolls rotatably mounted for feeding the material therefrom in a generally downward vertically-extending position past said cutting means, said cutting means comprises a driven rotary cutter, and a driven means carrying said cutter for selective horizontal back and forth movement transversely across the material fed by said material feeding means, and said control means including preset adjustable means for determining the amount of material fed by said nip-rolls past said cutting means and for actuating said control means for sequentially stopping said nip-rolls to stop the feed of material after a desired length of material has been fed past said cutting means, actuating said cutting means to effect a cutting cycle thereof, and again starting said nip-rolls for feeding of material.

7. Apparatus, as set forth in claim 6, in which said preset adjustable means in said control means comprises electrical pulse generating means operatively connected with said feeding nip-rolls for producing a predetermined number of electrical pulses for each revolution of said nip-rolls, and an electrical pulse counter means connected with said pulse generating means and having an adjustable preset output means operatively connected in said control means for actuation thereof after counting an adjustable preset number of electrical pulses.

8. Apparatus, as set forth in claim 6, in which said conveying means includes a driven endless belt conveyor means mounted for rotation to define an upper generally horizontally-extending surface of a width much narrower than the length of the cut pieces of material and positioned below said rotary cutter, and an elongate, generally horizontally-extending, top hold plate means positioned above said upper surface of said conveyor means and mounted for selective sequential pivotal movement into and out of engagement with said belt conveyor means for receiving and clamping one of the transverse cut ends of each cut piece after cutting by said cutter, and said apparatus further including clamping and positioning means cooperating with said cutting means and said conveying means and being controlled by said control means for clamping the material during operation of said cutting means and for positioning the cut end of the cut piece between said belt conveyor means and said top hold plate after operation of said cutting means.

9. Apparatus, as set forth in claims 2 or 3, in which said control means includes preset adjustable means for determining the amount of material fed by said feeding means past said cutting means and for actuating said control means for sequentially stopping said feeding means to stop the feed of material after a desired length of material has been fed past said cutting means, actuating said cutting means to effect a cutting cycle thereof, and again starting said feeding means for feeding of material, said preset adjustable means comprising electrical pulse generating means operatively connected with said feeding means for producing an electrical pulse for each predetermined increment of length of material fed by said feeding means, an electrical pulse counter means connected with said pulse generating means and having an adjustable preset output means operatively connected in said control means for actuation thereof after counting an adjustable preset number of electrical pulses corresponding to the desired length of material to be fed by said feeding means, and an optical color or shade photoelectric cell scanning device incorporated in said control means and selectively operable when said apparatus is fabricating the panel cut pillowcases only and connected with said pulse counter for being actuated thereby after said pulse counter has counted a preset number of pulses corresponding to the length of material between printed panel designs and for reading the location of such printed panel design and actuating said control means for fabricating panel cut pillowcases.

10. Apparatus, as set forth in claims 1 or 3, in which said material feeding means comprises selectively driven nip-rolls rotatably mounted for feeding the material therefrom in a generally downward vertically-extending position past said cutting means, said cutting means comprising a driven rotary cutter, and a driven endless chain and sprocket means carrying said cutter for selective horizontal back and forth movement transversely across the material fed by said material feeding means, said conveying means including a driven endless belt conveyor means mounted for rotation to define an upper generally horizontally-extending surface of a width much narrower than the width of the cut pieces of material and positioned below said rotary cutter, and an elongate, generally horizontally-extending, top hold plate means positioned above said upper surface of said conveyor means and mounted for selective sequential pivotal movement into and out of engagement with said conveyor means for receiving and clamping one of the transverse cut ends of each cut pieces after cutting by said cutter, and said apparatus further including clamping and positioning means cooperating with said cutting means and said conveying means and being controlled by said control means for clamping the material during operation of said cutting means and for positioning the cut end of the cut piece between said belt conveyor means and said top hold plate after operation of said cutting means.

11. Apparatus for sequentially fabricating pillowcases or like products comprising:

means for supplying continuous flat tubular material;

means for transversely cutting the continuous material into individual pieces comprising a driven rotary cutter, and a driven means carrying said cutter for selective horizontal back and forth movement transversely across the material;

means for feeding the continuous material from said supply means past said cutting means comprising selectively driven nip-rolls rotatably mounted for feeding the material therefrom in a generally downward vertically-extending position past said cutter;

conveying means including a driven endless belt conveyor means mounted for rotation to define an upper generally horizontally-extending surface of a width much narrower than the length of the cut pieces of material and positioned below said rotary cutter, and an elongate, generally horizontally-extending, top hold plate means positioned above said upper surface of said conveyor means and mounted for selective pivotal movement into and out of engagement with said belt conveyor means for receiving and clamping one of the transverse cut ends of each cut piece after cutting by said cutter while allowing the remainder of the cut pieces of material to hang downwardly in a generally vertically-extending position, and conveying the so-positioned cut pieces sequentially in a predetermined path of travel from said cutting means;

clamping and positioning means cooperating with said cutting means and said conveying means for clamping the material during operation of said cutting means and for positioning the cut end of the cut piece between said belt conveyor means and said top hold plate;

means for sequentially stitching the clamped transverse cut end of each of the cut pieces to complete fabrication of the pillowcases while each cut piece is being conveyed by said conveyor means with the remainder of each cut piece in the generally vertically-extending position; and control means operatively connected with and automatically controlling the operation of said cutting means, said feeding means, said conveying means, said clamping and positioning means and said stitching means for sequential operation thereof including means for regulating said cutting means and said feeding means for fabricating either regular cut pillowcases in which each pillowcase is cut a predetermined desired length or panel cut pillowcases in which each pillowcase is cut a predetermined desired length from printed panel designs on the material, said control means including preset adjustable means for determining the amount of material fed by said nip-rolls past said cutter and for actuating said control means for sequentially stopping said nip-rolls to stop the feed of material after a desired length of material has been fed past said cutting means, actuating said cutting means to effect a cutting cycle thereof, actuating said clamping and positioning means, actuating said conveying means and again starting said feeding means for another cycle; and said preset adjustable means comprising electrical pulse generating means operatively connected with said feeding nip-rolls for producing a predetermined number of electrical pulses for each revolution of said nip-rolls, an electrical pulse counter means connected with said pulse generating means and having an adjustable preset output means operatively connected in said control means for actuation thereof after counting an adjustable preset number of electrical pulses corresponding to the desired length of material to be fed by said feeding means, and optical color or shade photoelectric cell scanning device means incorporated in said control means and selectively operable when said apparatus is fabricating the panel cut pillowcases only and connected with said pulse counter for being actuated thereby after said pulse counter has counted a preset number of pulses corresponding to the length of material between printed panel designs and for reading the location of such printed panel design and actuating said control means for fabricating panel cut pillowcases.

* * * * *